US009601057B2

(12) United States Patent
Liu et al.

(10) Patent No.: US 9,601,057 B2
(45) **Date of Patent: *Mar. 21, 2017**

(54) PIXEL CIRCUIT, ORGANIC ELECTROLUMINESCE DISPLAY PANEL AND DISPLAY DEVICE

(71) Applicants: Shanghai Tianma AM-OLED Co., Ltd., Shanghai (CN); TIANMA MICRO-ELECTRONICS CO., LTD., Shenzhen (CN)

(72) Inventors: Gang Liu, Shanghai (CN); Chen Liu, Shanghai (CN); Dan Chen, Shanghai (CN); Dong Qian, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/167,863

(22) Filed: May 27, 2016

(65) Prior Publication Data

US 2016/0275866 A1 Sep. 22, 2016

Related U.S. Application Data

(63) Continuation of application No. 14/463,511, filed on Aug. 19, 2014.

(51) Int. Cl.
*G09G 3/32* (2016.01)

(52) U.S. Cl.
CPC ..... *G09G 3/3258* (2013.01); *G09G 3/3233* (2013.01); *G09G 3/3291* (2013.01);
(Continued)

(58) Field of Classification Search
CPC ..... G09G 3/3233; G09G 2300/0819; G09G 2320/043; G09G 2320/0233; G09G 3/3266;
(Continued)

(56) References Cited

U.S. PATENT DOCUMENTS

| | | | | |
|---|---|---|---|---|
| 8,780,102 | B2 * | 7/2014 | Han | G09G 3/3233 345/208 |
| 2005/0243036 | A1 * | 11/2005 | Ikeda | G09G 3/3233 345/76 |
| 2008/0158205 | A1 * | 7/2008 | Park | G09G 3/3225 345/204 |
| 2009/0167648 | A1 * | 7/2009 | Jeon | G09G 3/3233 345/76 |
| 2011/0090213 | A1 * | 4/2011 | Han | G09G 3/3233 345/213 |
| 2011/0134100 | A1 * | 6/2011 | Chung | G09G 3/325 345/212 |
| 2013/0194248 | A1 * | 8/2013 | Kim | G09G 3/3233 345/212 |
| 2014/0333515 | A1 * | 11/2014 | In | G09G 3/3233 345/82 |

(Continued)

*Primary Examiner* — Hong Zhou
(74) *Attorney, Agent, or Firm* — Alston & Bird LLP

(57) ABSTRACT

A pixel circuit, an organic electroluminescent display panel and a display device are provided. The pixel circuit includes a light emitting element, a first capacitor, a reset control module, a drive control module, a compensation control module, and a light emission control module. In a reset phase, the reset control module writes a reset signal at a reset signal end into a second end of the first capacitor. In a compensation phase, the reset control module writes a data signal at a data signal end into a first end of the first capacitor, and the drive control module charges the first capacitor through the compensation control module. In a light emission phase, both the light emission control module and the first capacitor enable the drive control module to drive the light emitting element with a stable current for emission of light.

19 Claims, 20 Drawing Sheets

(52) U.S. Cl.
CPC . *G09G 2230/00* (2013.01); *G09G 2300/0439* (2013.01); *G09G 2300/0819* (2013.01); *G09G 2300/0852* (2013.01); *G09G 2300/0861* (2013.01); *G09G 2310/0262* (2013.01); *G09G 2310/062* (2013.01); *G09G 2310/08* (2013.01); *G09G 2320/0233* (2013.01); *G09G 2320/045* (2013.01)

(58) Field of Classification Search
CPC ..... G09G 3/3208; G09G 2300/043; G09G 2300/0426; G09G 3/30; G09G 3/3225; G09G 3/3283; G09G 2310/0202; G09G 2230/00; G09G 2300/0439; G09G 2300/0852; G09G 2300/0861; G09G 2310/0262; G09G 2310/062; G09G 2310/08; G09G 2320/045; G09G 3/3258; G09G 3/3291; H05B 33/0896
USPC ..... 345/36, 39, 45–46, 76–82; 315/169.3
See application file for complete search history.

(56) References Cited

U.S. PATENT DOCUMENTS

2015/0002557 A1* 1/2015 Ishii ..... G09G 3/3291 345/690

* cited by examiner

PIXEL CIRCUIT, ORGANIC ELECTROLUMINESCE DISPLAY PANEL AND DISPLAY DEVICE

CROSS-REFERENCES TO RELATED APPLICATIONS

This application is a continuation of U.S. patent application Ser. No. 14/463,511 which claims the benefit of priority to Chinese Patent Application No. 201410253894.5, filed with the Chinese Patent Office on Jun. 9, 2014 and entitled "PIXEL CIRCUIT, ORGANIC ELECTROLUMINESCE DISPLAY PANEL AND DISPLAY DEVICE", the content of which is incorporated herein by reference in its entirety.

FIELD OF THE INVENTION

The present invention relates to the field of organic electroluminescent technologies and particularly to a pixel circuit, an organic electroluminescent display panel and a display device.

BACKGROUND OF THE INVENTION

Organic Light Emitting Diode (OLED) displays have become one of focuses in the research field of flat panel displays at present, and the OLED displays have low power consumption, low production cost, self-luminescence, wide angle of view, high response speed and other advantages over liquid crystal displays. At present, the OLED display screens have come to take the place of traditional Liquid Crystal Display (LCD) screens in the display field of handsets, Personal Digital Assistants (PDAs), digital cameras and the like. Particularly, the design of pixel circuits is the core of technical matters in the OLED displays and has important research significance.

Unlike an LCD for which the brightness is controlled by a stable voltage, a current-driven OLED needs a stable current to control the emission of light. The threshold voltage $V_{th}$ of a drive transistor of a pixel circuit is not uniform due to the process flow, aging of elements and other reasons, so that the current flowing through OLEDs of respective pixels varies, thus resulting in non-uniform display brightness, thereby degrading the display quality of the entire image.

For example, in an existing 2T1C pixel circuit as illustrated in FIG. 1, the circuit consists of a drive transistor T2, a switch transistor T1 and a storage capacitor Cs. When a row is selected by a scan line Scan, a low-level signal is input by the scan line Scan, the P-type switch transistor T1 is turned on, and a voltage of a data line Data is written into the storage capacitor Cs; and after the scanning of the row ends, the signal input by the scan line Scan is changed to a high level, the P-type switch transistor T1 is turned off, and a current is generated by the drive transistor T2 due to a gate voltage stored in the storage capacitor Cs to drive the OLED so that the OLED emits light continuously for a frame. Particularly the saturated current of the drive transistor T2 is defined in the equation of $I_{OLED}=K(V_{SG}-V_{th})^2$, and as described above, there may be a drift of the threshold voltage $V_{th}$ of the drive transistor T2 due to the process flow, aging of elements and other reasons, so that the current flowing through respective OLEDs varies due to the varying threshold voltage $V_{th}$ of the drive transistor, thus resulting in non-uniform image brightness.

BRIEF SUMMARY OF THE INVENTION

In view of this, embodiments of the present invention provide a pixel circuit, an organic electroluminescent display panel and a display device so as to improve the uniformity of image brightness in a display area of the display device.

An embodiment of the invention provides a pixel circuit, which includes: a light emitting element, a first capacitor, a reset control module, a drive control module, a compensation control module and a light emission control module, wherein:

a first signal end of the reset control module is connected with a data signal end, a second signal end of the reset control module is connected with a reset control signal end, and a third signal end of the reset control module is connected respectively with a first end of the first capacitor and a first signal end of the light emission control module; and a fourth signal end of the reset control module is connected with a first scan signal end, a fifth signal end of the reset control module is connected with a reset signal end, and a sixth signal end of the reset control module is connected respectively with a second end of the first capacitor, a first signal end of the compensation control module and a first signal end of the drive control module;

a second signal end of the drive control module is connected with a first reference signal end, and a third signal end of the drive control module is connected respectively with a second signal end of the compensation control module and a second signal end of the light emission control module; and a third signal end of the compensation control module is connected with a second scan signal end;

a third signal end of the light emission control module is connected with a light emission control signal end, a fourth signal end of the light emission control module is connected with a second reference signal end, and a fifth signal end of the light emission control module is connected with a first end of the light emitting element; and a second end of the light emitting element is connected with a third reference signal end; and in a reset phase, the reset control module writes a reset signal transmitted from the reset signal end into the second end of the first capacitor under control of the first scan signal end.

An embodiment of the invention provides a pixel circuit, which includes: a light emitting element, a first capacitor, a drive transistor, a first switch element, a second switch element, a third switch element, a fourth switch element and a fifth switch element, wherein:

a source of the drive transistor is connected with a first reference signal end, a drain of the drive transistor is connected respectively with a signal input end of the first switch element and a signal input end of the fifth switch element, and a gate of the drive transistor is connected respectively with a second end of the first capacitor, a signal output end of the third switch element and a signal output end of the first switch element; and a control end of the first switch element is connected with a second scan signal end;

a signal input end of the second switch element is connected with a data signal end, a signal output end of the second switch element is connected respectively with a first end of the first capacitor and a signal output end of the fourth switch element, and a control end of the second switch element is connected with a reset control signal end;

a signal input end of the third switch element is connected with a reset signal end, and a control end of the third switch element is connected with a first scan signal end;

a signal input end of the fourth switch element is connected with a second reference signal end, and a control end of the fourth switch element is connected respectively with a control end of the fifth switch element and a light emission control signal end; and a first end of the light emitting element is connected with a signal output end of the fifth switch element, and a second end of the light emitting element is connected with a third reference signal end.

An embodiment of the invention further provides an organic electroluminescent display panel which includes a plurality of the pixel circuits according to any one of the above embodiments of the invention.

An embodiment of the invention further provides a display device which includes any organic electroluminescent display panel according to the above embodiment of the invention.

DETAILED DESCRIPTION OF THE INVENTION

Specific implementations of a pixel circuit, an organic electroluminescent display panel and a display device according to embodiments of the invention will be described below in details with reference to the drawings.

Figure 1:
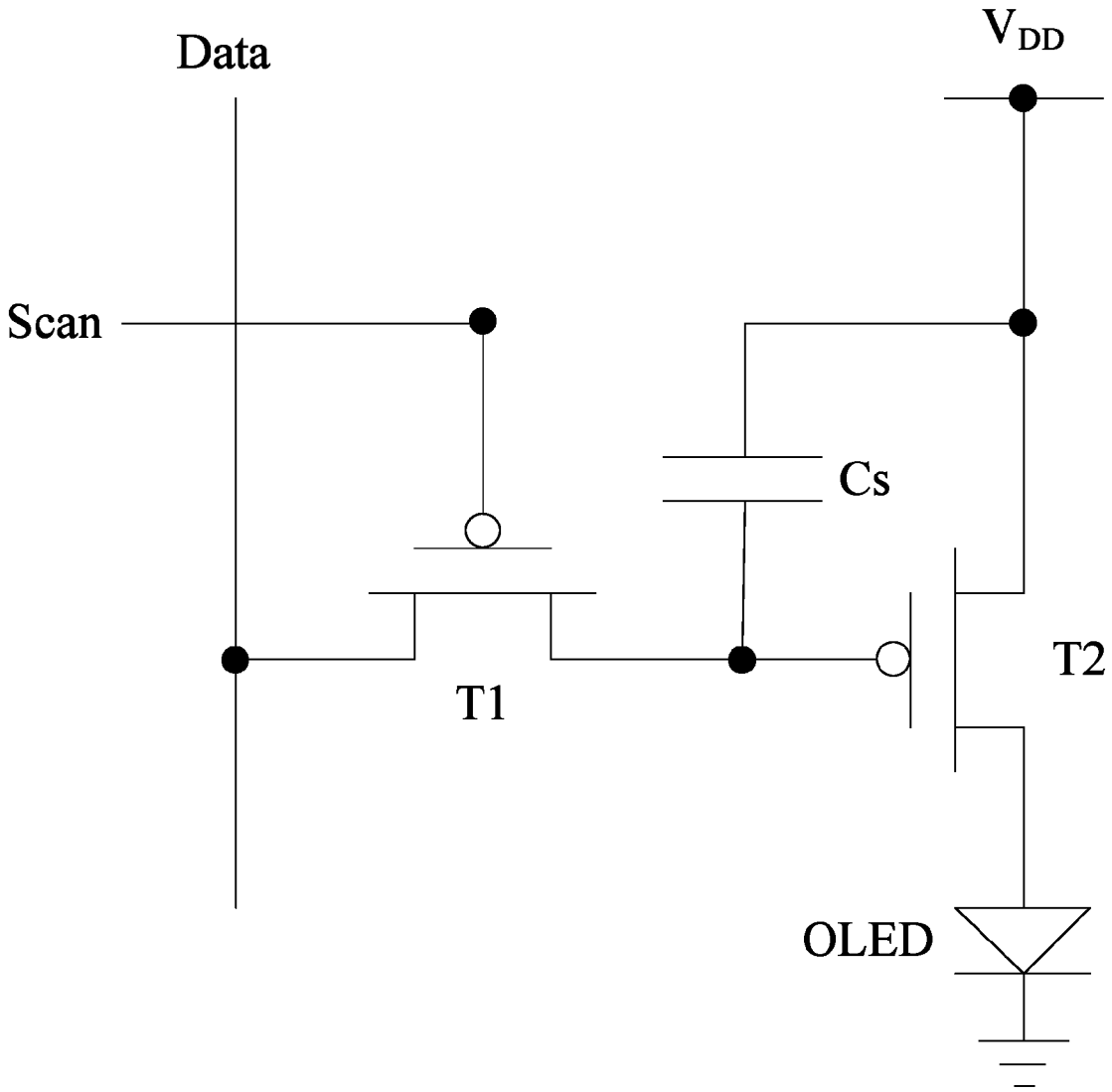
FIG. 1 (Prior Art)
FIG. 1 is a schematic structural diagram of an existing 2T1C pixel circuit in the prior art.
Figure 2A:
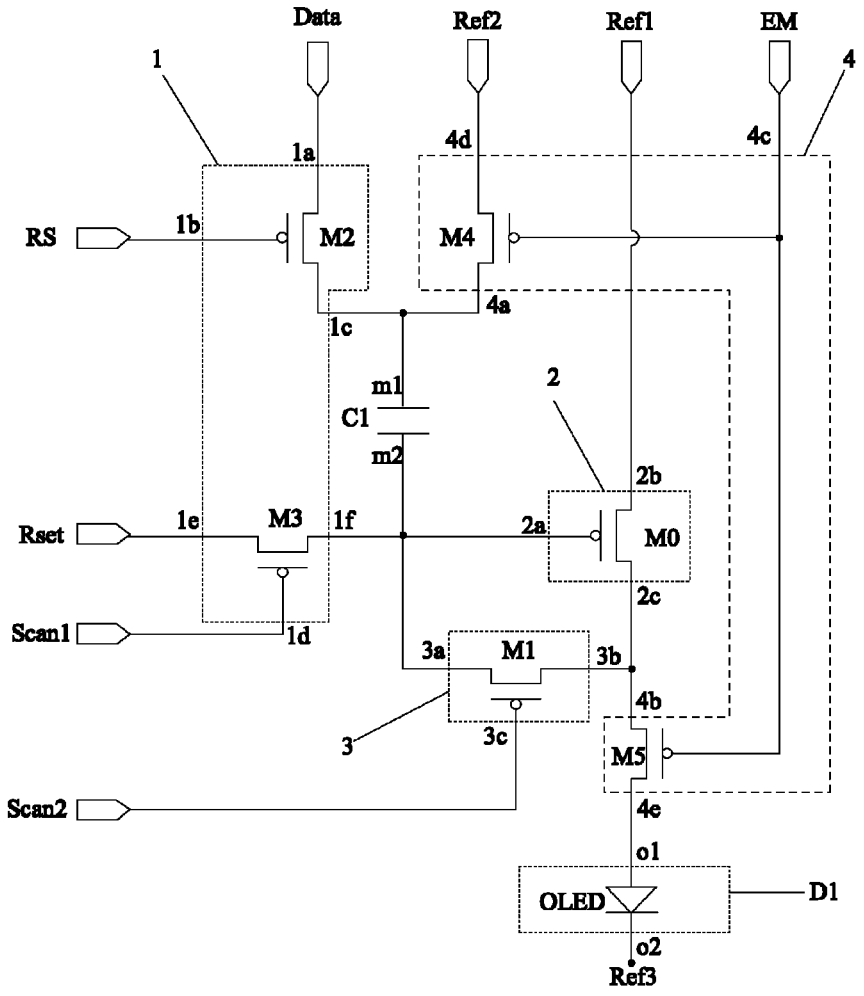
FIG. 2A is a schematic structural diagram of a pixel circuit according to one embodiment of the invention.

As illustrated in FIG. 2A, a pixel circuit according to an embodiment of the invention includes a light emitting element D1, a first capacitor C1, a reset control module 1, a drive control module 2, a compensation control module 3 and a light emission control module 4.

A first signal end 1*a* of the reset control module 1 is connected with a data signal end Data, a second signal end 1*b* of the reset control module 1 is connected with a reset control signal end RS, and a third signal end 1*c* of the reset control module 1 is connected respectively with a first end m1 of the first capacitor C1 and a first signal end 4*a* of the light emission control module 4; and a fourth signal end 1*d* of the reset control module 1 is connected with a first scan signal end Scan1, a fifth signal end 1*e* of the reset control module 1 is connected with a reset signal end Rset, and a sixth signal end 1*f* of the reset control module 1 is connected respectively with a second end m2 of the first capacitor C1, a first signal end 3*a* of the compensation control module 3 and a first signal end 2*a* of the drive control module 2.

A second signal end 2*b* of the drive control module 2 is connected with a first reference signal end Ref1, and a third signal end 2*c* of the drive control module 2 is connected respectively with a second signal end 3*b* of the compensation control module 3 and a second signal end 4*b* of the light emission control module 4; and a third signal end 3*c* of the compensation control module 3 is connected with a second scan signal end Scan2.

A third signal end 4*c* of the light emission control module 4 is connected with a light emission control signal end EM, a fourth signal end 4*d* of the light emission control module 4 is connected with a second reference signal end Ref2, and a fifth signal end 4*e* of the light emission control module 4 is connected with a first end o1 of the light emitting element D1; and a second end o2 of the light emitting element D1 is connected with a third reference signal end Ref3.

In a reset phase, the reset control module 1 writes a reset signal transmitted from the reset signal end Rset into the second end m2 of the first capacitor C1 under control of the first scan signal end Scan1; in a compensation phase, the reset control module 1 writes a data signal transmitted from the data signal end Data into the first end m1 of the first capacitor C1 under control of the reset control signal end RS, and the drive control module 2 charges the first capacitor C1 through the compensation control module 3 under control of the second scan signal end Scan2; and in a light emission phase, both the light emission control module 4 and the first capacitor C1 control the drive control module 2 to drive the light emitting element D1 to emit light under control of the light emission control signal end EM.

In the above pixel circuit according to the embodiment of the invention, the compensation control module can compensate for a drift of the threshold voltage in the drive control module in the compensation phase, so in the light emission phase, an operating current at which the drive control module drives the light emitting element to emit light can be only related to the voltage of the data signal input at the data signal end and the voltage at the second reference signal end but independent of the threshold voltage in the drive control module to thereby avoid the influence of the threshold voltage on the light emitting element, so as to stabilize the operating current driving the light emitting element to emit light and improve the uniformity of image brightness in the display area of the display device.

Figure 2B:
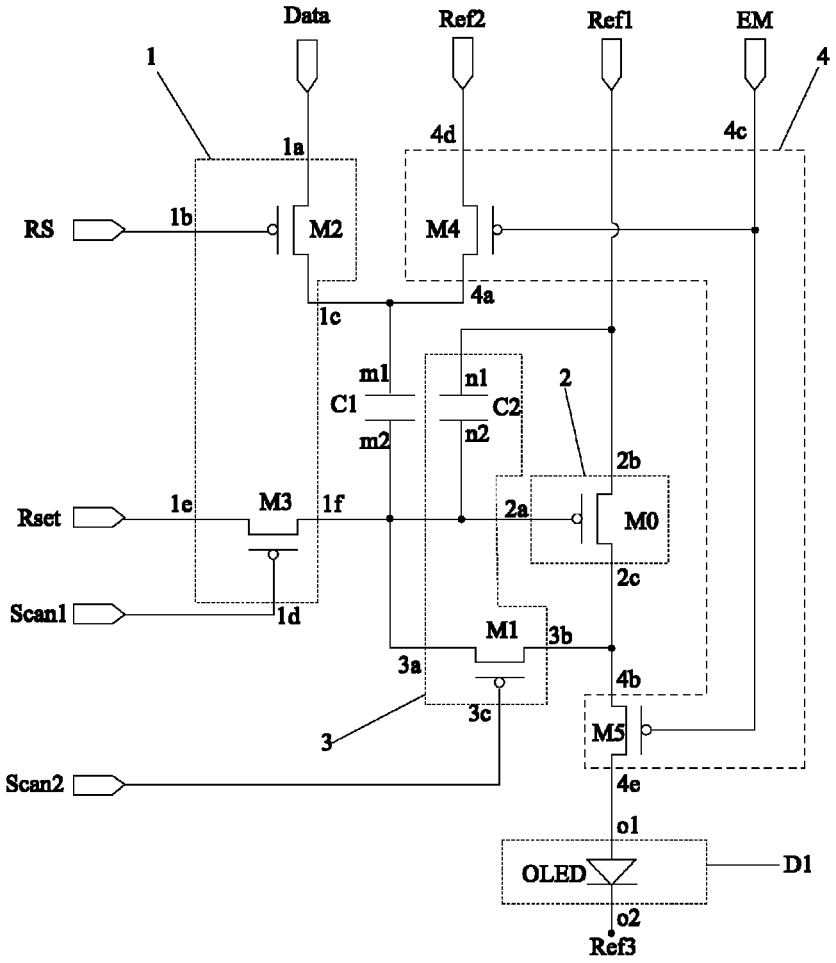
FIG. 2B is a schematic structural diagram of a pixel circuit according to another embodiment of the invention.

Preferably, for the sake of a convenient implementation, in the above pixel circuit according to the embodiment of the invention, as illustrated in FIG. 2A and FIG. 2B, the drive control module 2 can particularly include a drive transistor M0.

A gate of the drive transistor M0 is the first signal end 2*a* of the drive control module 2, a source of the drive transistor M0 is the second signal end 2*b* of the drive control module 2, and a drain of the drive transistor M0 is the third signal end 2*c* of the drive control module 2.

In a particular implementation, the light emitting element D1 in the above pixel circuit according to the embodiment of the invention is generally an Organic Light Emitting Diode (OLED). The light emitting element D1 is operated to emit light for display under the action of the saturated current of the drive transistor M0.

In a particular implementation, in the above pixel circuit according to the embodiment of the invention, the drive transistor M0 driving the light emitting element to emit light is generally a P-type transistor. The threshold voltage $V_{th}$ of the P-type transistor is negative, so in order to ensure the normal operation of the drive transistor M0, the voltage at the first reference signal end Ref1 needs to be a positive voltage, and the voltage at the third reference signal end Ref3 needs to be lower than the voltage at the first reference signal end Ref1. The voltage at the third reference signal end Ref3 being zero will be taken as an example for illustration throughout the following description.

In a particular implementation, in the above pixel circuit according to the embodiment of the invention, as illustrated in FIG. 2A to FIG. 6B, the compensation control module can particularly include a first switch transistor M1.

A gate of the first switch transistor M1 is connected with the second scan signal end Scan2, a source of the first switch transistor M1 is connected with the drain of the drive transistor M0, and a drain of the first switch transistor Ml is connected with the second end m2 of the first capacitor C1.

Particularly in a particular implementation, the first switch transistor can be an N-type transistor or can be a P-type transistor, and the invention will not be limited in this regard. When the first switch transistor is an N-type transistor, the first switch transistor is turned on when the signal at the second scan signal end is at a high level; and when the first switch transistor is a P-type transistor, the first switch transistor is turned on when the signal at the second scan signal end is at a low level.

Particularly when the compensation control module in the above pixel circuit according to the embodiment of the invention is structured particularly as the first switch transistor, it operates under such a principle that in the compensation phase, the second scan signal end controls the first switch transistor to be turned on, and the turned-on first switch transistor changes the drive transistor into a diode, so that after turning on the diode, the voltage $V_{ref1}$ at the first reference signal end charges the first capacitor until the voltage at the second end of the first capacitor is $V_{ref1}-|V_{th}|$, to thereby achieve the storing of the threshold voltage $|V_{th}|$ of the drive transistor at the gate of the drive transistor. The first switch transistor is turned off in both the reset phase and the light emission control phase.

In a particular implementation, in the above pixel circuit according to embodiments of the invention, as illustrated in FIG. 2A to FIG. 6B, the reset control module can particularly include a second switch transistor M2 and a third switch transistor M3.

A gate of the second switch transistor M2 is connected with the reset control signal end RS, a source of the second switch transistor M2 is connected with the data signal end Data, and a drain of the second switch transistor M2 is connected with the first end m1 of the first capacitor C1.

A gate of the third switch transistor M3 is connected with the first scan signal end Scan1, a source of the third switch transistor M3 is connected with the reset signal end Rset, and a drain of the third switch transistor M3 is connected with the second end m2 of the first capacitor C1.

Particularly in a specific implementation, the second switch transistor can be an N-type transistor or can be a P-type transistor, and the invention will not be limited in this regard. When the second switch transistor is an N-type transistor, the second switch transistor is turned on when the signal at the reset control signal end is at a high level; and when the second switch transistor is a P-type transistor, the second switch transistor is turned on when the signal at the reset control signal end is at a low level.

Particularly in a specific implementation, the third switch transistor can be an N-type transistor or can be a P-type transistor, and the invention will not be limited in this regard. When the third switch transistor is an N-type transistor, the third switch transistor is turned on when the signal at the first scan signal end is at a high level; and when the third switch transistor is a P-type transistor, the third switch transistor is turned on when the signal at the first scan signal end is at a low level.

Particularly when the reset control module in the above pixel circuit according to the embodiment of the invention is structured specifically as the second switch transistor and the third switch transistor described above, it operates in such a way that in the reset phase, the first scan signal end controls the third switch transistor to be turned on, and the turned-on third switch transistor writes the reset signal $V_{rset}$ transmitted from the reset signal end into the second end of the first capacitor, so that the voltage at the second end of the first capacitor is $V_{rset}$, thereby ensuring that the voltage at the gate of the drive transistor is $V_{rset}$ in this phase. In this phase, the second switch transistor can be turned on or can be turned off. In the compensation phase, the reset control signal end controls the second switch transistor to be turned on, and the turned-on second switch transistor writes the data signal $V_{data}$ transmitted from the data signal end into the first end of the first capacitor, so that the voltage at the first end of the first capacitor is $V_{data}$, and the third switch transistor is turned off in this phase. Both the second switch transistor and the third switch transistor are turned off in the light emission control phase.

Preferably in order to simplify the fabrication process, in the above pixel circuit according to the embodiment of the invention, all of the first switch transistor, the second switch transistor and the third switch transistor can be P-type transistors or can be N-type transistors, and the invention will not be limited in this regard.

Figure 3A:
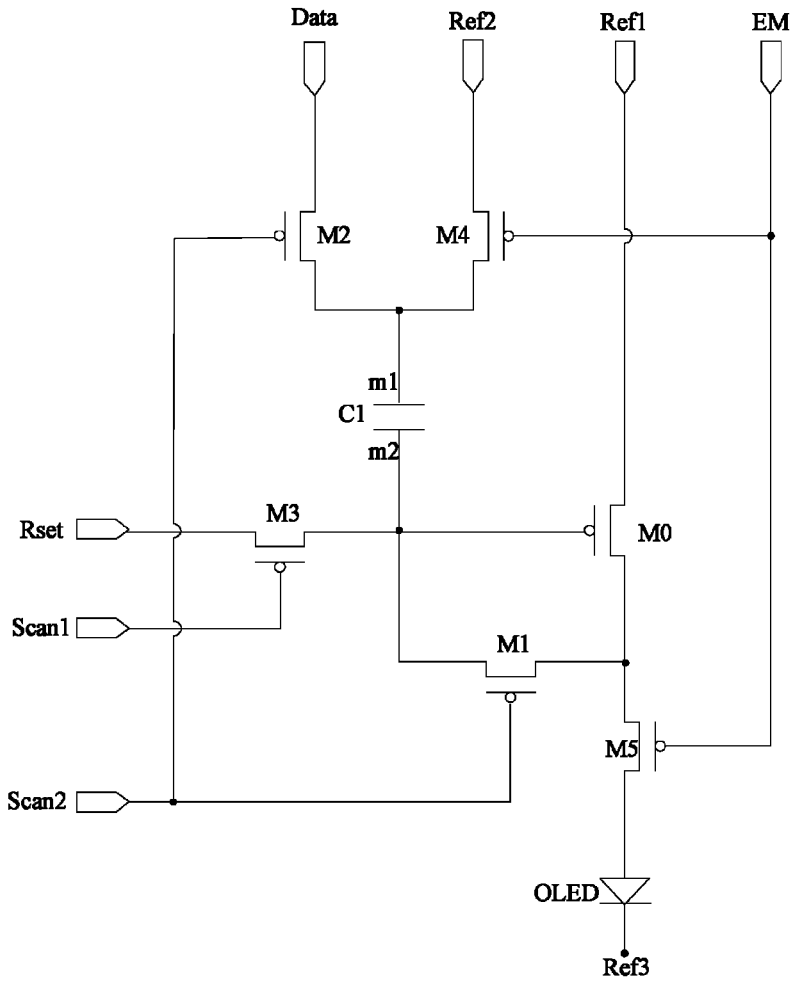
FIG. 3A is a detailed schematic structural diagram of a pixel circuit according to one embodiment of the invention.
Figure 3B:
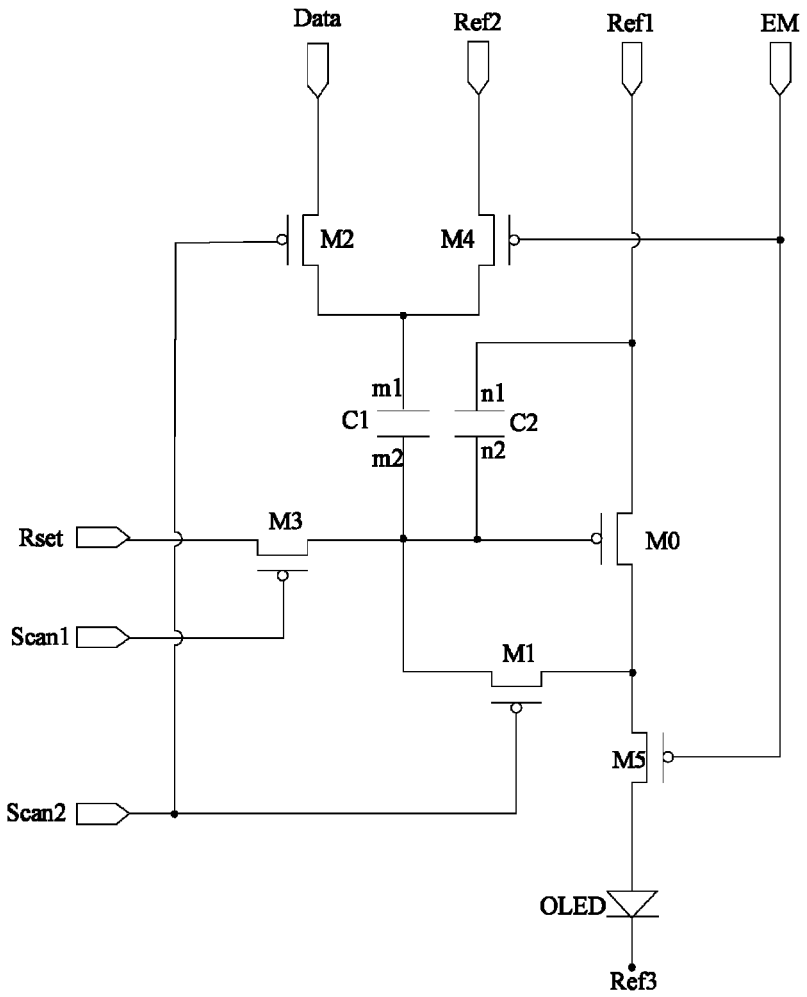
FIG. 3B is a detailed schematic structural diagram of a pixel circuit according to another embodiment of the invention.
Figure 4A:
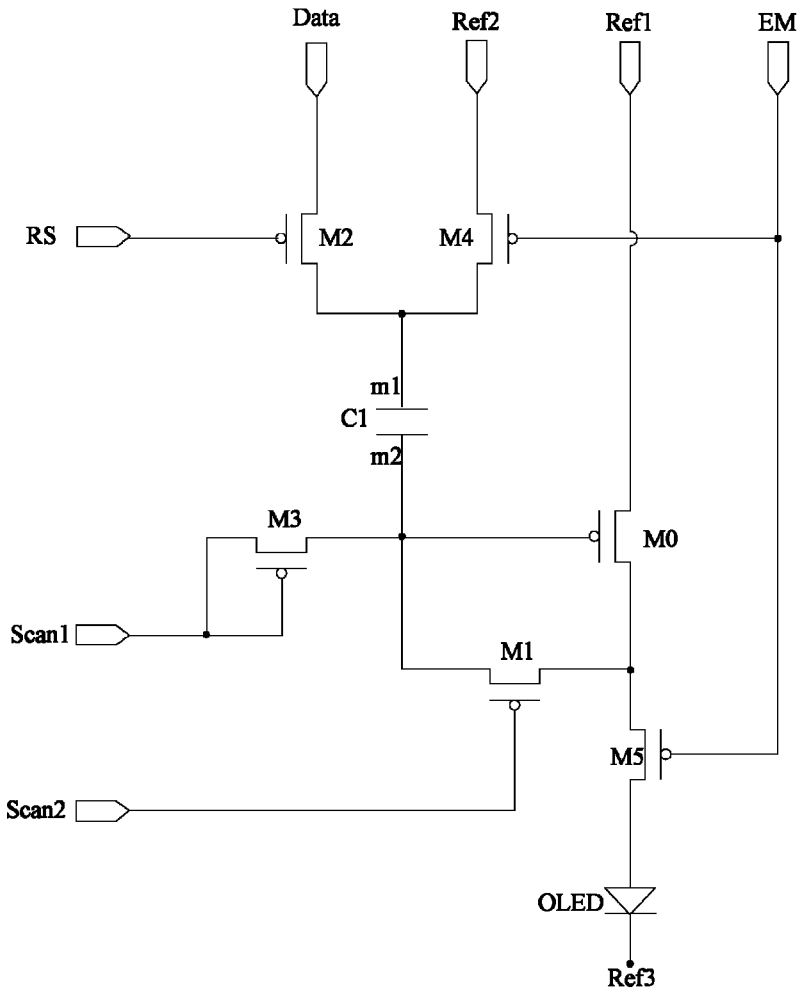
FIG. 4A is a detailed schematic structural diagram of a pixel circuit according to another embodiment of the invention.
Figure 4B:
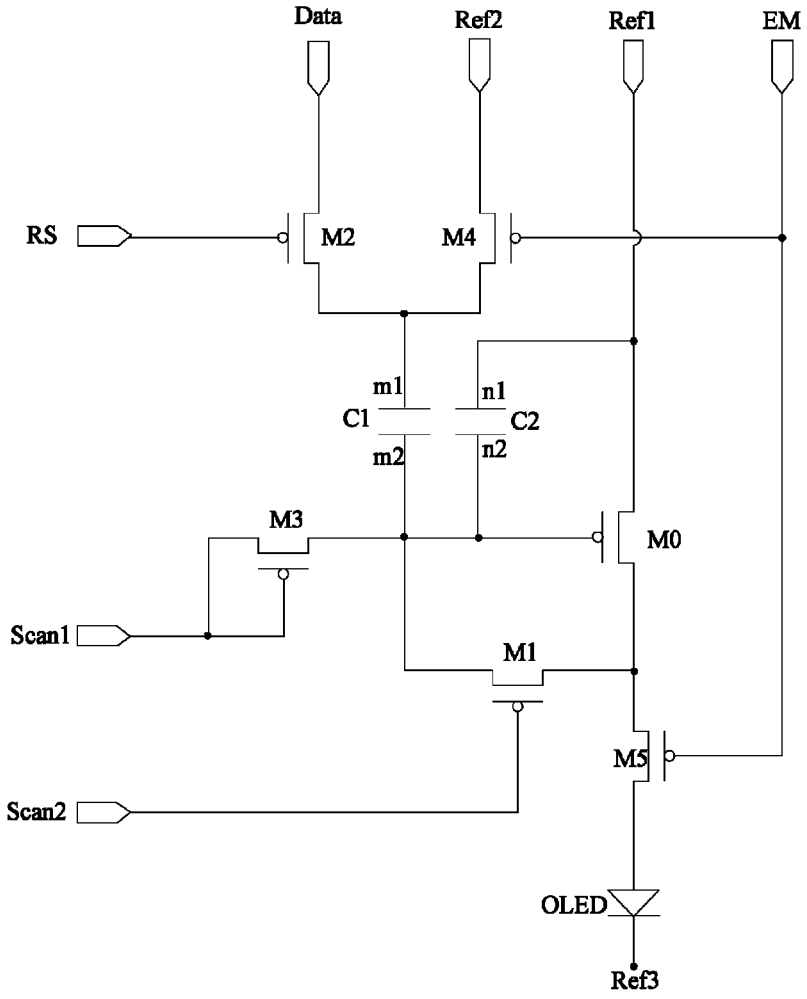
FIG. 4B is a detailed schematic structural diagram of a pixel circuit according to another embodiment of the invention.

Preferably in order to simplify the circuit structure, in the above pixel circuit according to the embodiment of the invention, when all of the first switch transistor, the second switch transistor and the third switch transistor are P-type transistors or N-type transistors, as illustrated in FIG. 3A and FIG. 3B, the reset control signal end RS can be the second scan signal end Scan2, that is, both the first switch transistor M1 and the second switch transistor M2 are controlled by the second scan signal end to be turned on and off; or when all of the first switch transistor, the second switch transistor and the third switch transistor are P-type transistors or N-type transistors, as illustrated in FIG. 4A and FIG. 4B, the reset signal end Rset can be the first scan signal end Scan1 or can be the second reference signal end Ref2. When the reset signal end Rset is the first scan signal end Scan1, the first scan signal end Scan/controls the third switch transistor M3 to be turned on and off, and also inputs the reset signal to the source of the third switch transistor M3.

Figure 5A:
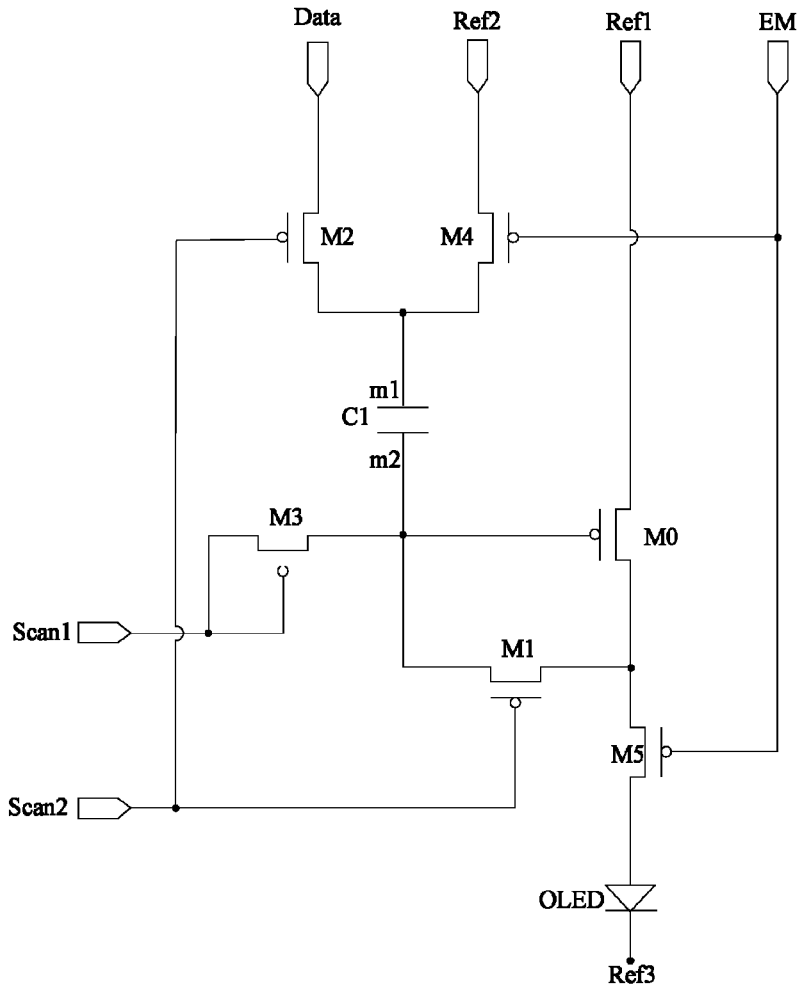
FIG. 5A is a detailed schematic structural diagram of a pixel circuit according to another embodiment of the invention.
Figure 5B:
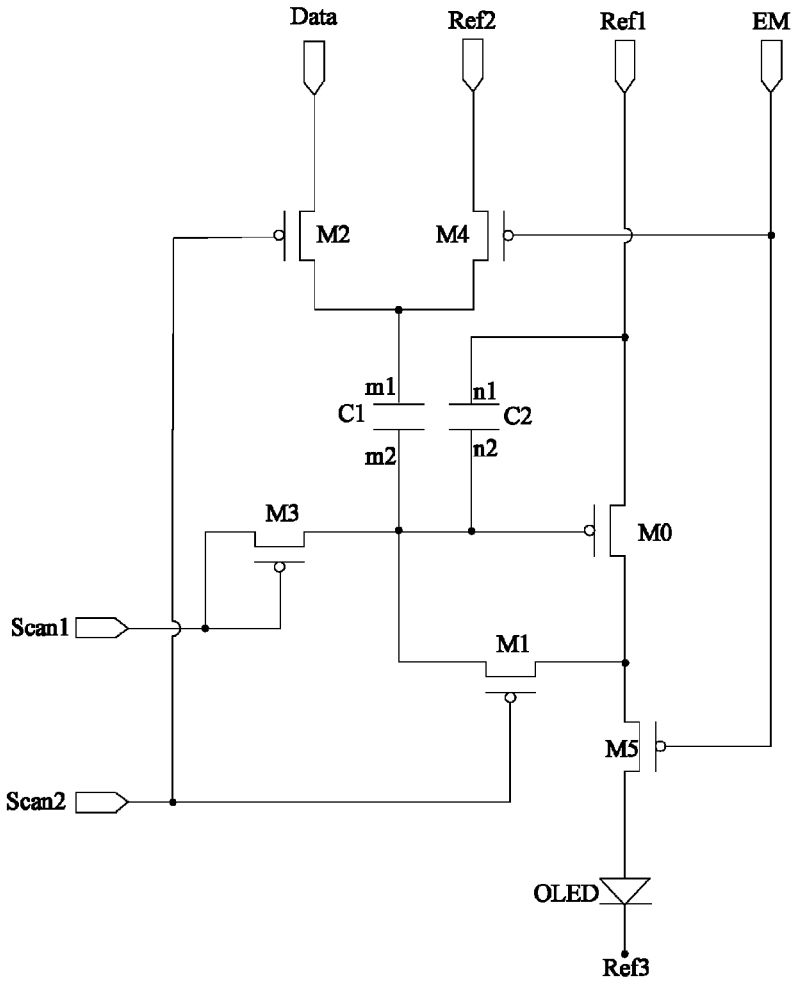
FIG. 5B is a detailed schematic structural diagram of a pixel circuit according to another embodiment of the invention.

Preferably in order to further simplify the circuit structure, in the above pixel circuit according to the embodiment of the invention, when all of the first switch transistor, the second switch transistor and the third switch transistor are P-type transistors or N-type transistors, as illustrated in FIG. 5A and FIG. 5B, the reset control signal end RS is the second scan signal end Scan2, and the reset signal end Rset is the first scan signal end Scan1; or the reset control signal end RS is the second scan signal end Scan2, and the reset signal end Rset is the second reference signal end Ref2.

In a particular implementation, in the above pixel circuit according to the embodiment of the invention, as illustrated in FIG. 2A to FIG. 6B, the light emission control module can particularly include a fourth switch transistor M4 and a fifth switch transistor M5.

Both a gate of the fourth switch transistor M4 and a gate of the fifth switch transistor M5 are connected with the light emission control signal end EM, a source of the fourth switch transistor M4 is connected with the second reference signal end Ref2, and a drain of the fourth switch transistor M4 is connected with the first end m1 of the first capacitor C1.

A source of the fifth switch transistor M5 is connected with the drain of the drive transistor M0, and a drain of the fifth switch transistor M5 is connected with the first end of the light emitting element D1.

Preferably, in order to simplify the fabrication process, in the above pixel circuit according to the embodiment of the invention, both the fourth switch transistor and the fifth switch transistor are P-type transistors or N-type transistors, and the invention will not be limited in this regard. When both the fourth switch transistor and the fifth switch transistor are N-type transistors, the fourth switch transistor and the fifth switch transistor are turned on when the signal at the light emission control signal end is at a high level; and when both the fourth switch transistor and the fifth switch transistor are P-type transistors, the fourth switch transistor and the fifth switch transistor are turned on when the signal at the light emission control signal end is at a low level.

Particularly when the light emission control module in the above pixel circuit according to the embodiment of the invention is structured particularly as the fourth switch transistor and the fifth switch transistor described above, it operates under such a principle that in the light emission control phase, the light emission control signal end controls the fourth switch transistor and the fifth switch transistor to be turned on, and the turned-on fourth switch transistor writes the voltage $V_{ref2}$ at the second reference signal end into the first end of the first capacitor, so that the voltage at the first end of the first capacitor is changed from $V_{data}$ in the compensation phase to $V_{ref2}$, and due to the bootstrap function of the capacitor, the voltage at the second end of the first capacitor is changed from $V_{ref1}-|V_{th}|$ in the compensation phase to $V_{ref1}-|V_{th}|+V_{ref2}-V_{data}$ according to the principle of charge conservation of the capacitor, and in this phase, since the drive transistor operates in the saturation state, it can be seen from the current characteristic in the saturation state that the operating current $I_{OLED}$ flowing through the drive transistor and used to drive the light emitting element to emit light satisfies the equation of $I_{OLED}=K(V_{sg}-|V_{th}|)^2=K[V_{ref1}-(V_{ref1}-|V_{th}|+V_{ref2}-V_{data})-|V_{th}|]^2=K(V_{data}-V_{ref2})^2$, where K is a structural parameter, which is relatively stable and thus can be regarded as a constant in the same structure. As can be apparent, the operating current $I_{OLED}$ of the light emitting element has been independent of the threshold voltage $V_{th}$ of the drive transistor but only related to the voltage $V_{data}$ of the data signal input at the data signal end and the voltage $V_{ref2}$ at the second reference signal end to thereby thoroughly avoid the operating current $I_{OLED}$ of the light emitting element D1 from being influenced by the drift of the threshold voltage $V_{th}$ of the drive transistor due to the process flow and running for a long period of time, so as to ensure the normal operation of the light emitting element D1.

Figure 6A:
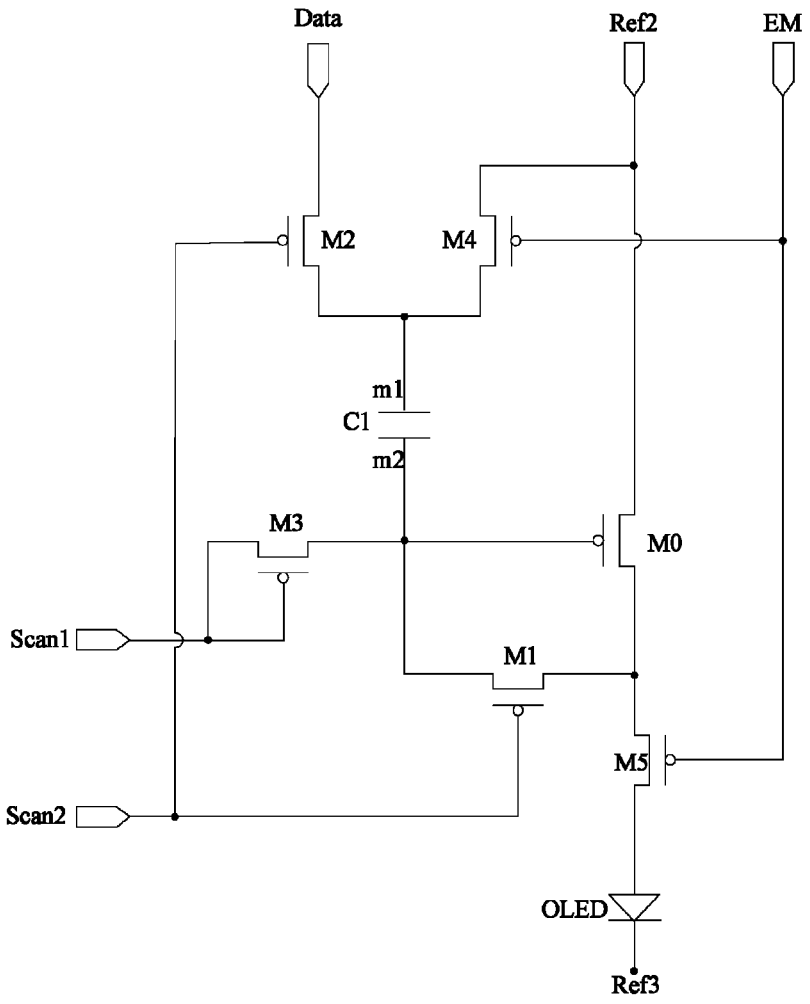
FIG. 6A is a detailed schematic structural diagram of a pixel circuit according to another embodiment of the invention.
Figure 6B:
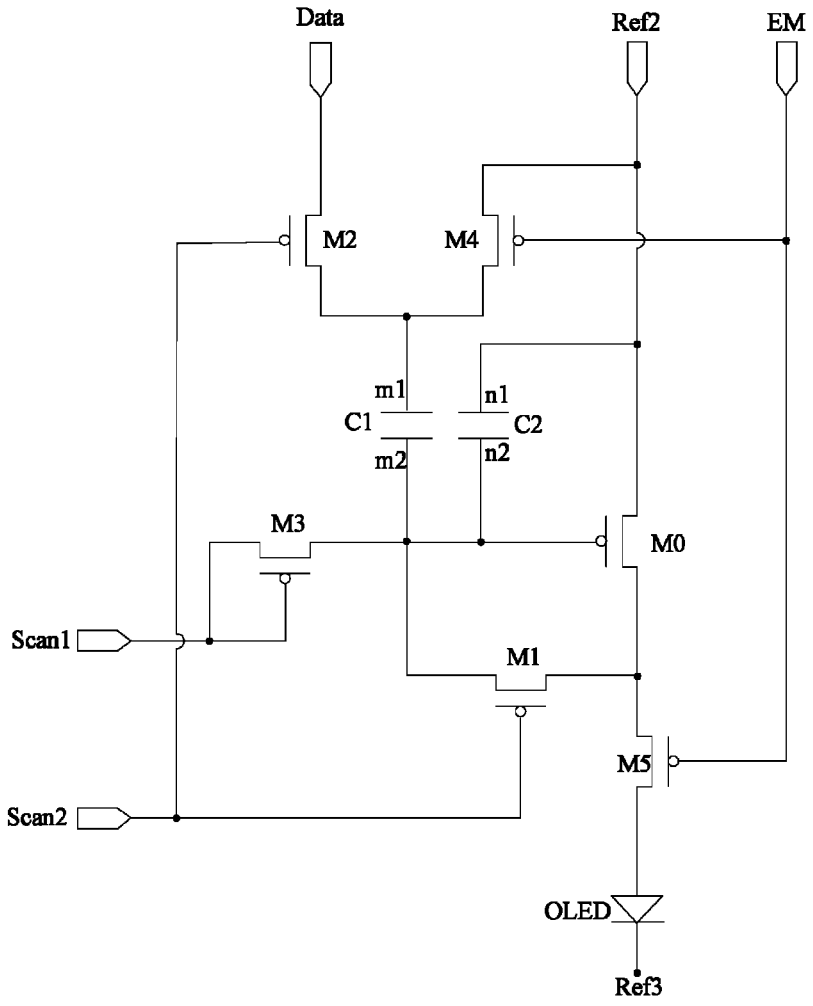
FIG. 6B is a detailed schematic structural diagram of a pixel circuit according to another embodiment of the invention.

Preferably in order to simplify the circuit structure, in the above pixel circuit according to the embodiment of the invention, as illustrated in FIG. 6A and FIG. 6B, the first reference signal end Ref1 is the second reference signal end Ref2.

Preferably in the above pixel circuit according to the embodiment of the invention, in order to stabilize the voltage at the gate of the drive transistor, as illustrated in FIG. 2B, FIG. 3B, FIG. 4B, FIG. 5B and FIG. 6B, the compensation control module can further include a second capacitor C2.

A first end n1 of the second capacitor C2 is connected with the first reference signal end Ref1, and a second end n2 of the second capacitor C2 is connected with the gate of the drive transistor M0.

Particularly when the compensation control module in the above pixel circuit according to the embodiment of the invention is structured specifically as the first switch transistor and the second capacitor described above, it operates in such a way that in the compensation phase, the second scan signal end controls the first switch transistor to be turned on, and the turned-on first switch transistor changes the drive transistor into a diode, so that after turning on the diode, the voltage $V_{ref1}$ at the first reference signal end charges the first capacitor and the second capacitor until the voltage at the second end of the first capacitor is $V_{ref1}-|V_{th}|$, and at this time the voltage difference across the first capacitor is $V_{data}-V_{ref1}+|V_{th}|$, and the voltage difference across the second capacitor is $|V_{th}|$, thereby achieving the storing of the threshold voltage $|V_{th}|$ of the drive transistor at the gate of the drive transistor. The first switch transistor is turned off in both the reset phase and the light emission control phase.

It shall be noted that the drive transistor and the switch transistors mentioned in the above embodiments of the invention can be Thin Film Transistors (TFTs) or can be Metal Oxide Semiconductor (MOS) field effect transistors, and the invention will not be limited in this regard. In a particular implementation, the sources and the drains of these transistors can be interchanged without being distinguished from each other. The particular embodiments are described by taking the drive transistor and the switch transistors, all of which are thin film transistors, as an example.

Moreover preferably, all of the drive transistor and the switch transistors mentioned in the above embodiments of the invention can be embodied as P-type transistors, thereby simplifying the process flow of fabricating the pixel circuit.

The operation principle of the above pixel circuit will be described below in details by taking the drive transistor and the switch transistors in the pixel circuit, all of which are P-type transistors, as an example.

Figure 7:
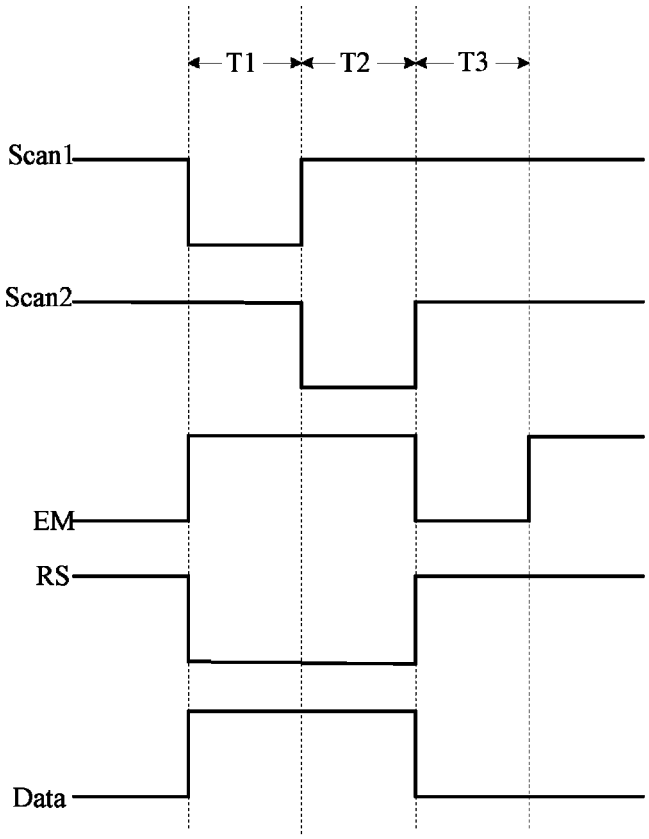
FIG. 7 is a circuit timing diagram of a pixel circuit according to the embodiments.

An Example:

Taking the pixel circuit illustrated in FIG. 2A as an example, FIG. 7 illustrates a corresponding timing diagram of the circuit.

In the reset phase T1, both the signal at the reset control signal end RS and the signal at the first scan signal end Scan1 are low-level signals, and the second switch transistor M2 and the third switch transistor M3 are turned on; and both the signal at the second scan signal end Scan2 and the signal at the light emission control signal end EM are high-level signals, and the first switch transistor M1, the fourth switch transistor M4, the fifth switch transistor M5 and the drive transistor M0 are turned off. The data signal $V_{data}$ at the data signal end Data is written into the first end m1 of the first capacitor C1 through the second switch transistor M2, and the reset signal $V_{rset}$ at the reset signal end Rset is written into the second end m2 of the first capacitor C1 through the third switch transistor M3, so that the voltage at the first end m1 of the first capacitor C1 is $V_{data}$, and the voltage at the second end m2 of the first capacitor C1 is $V_{rset}$, thereby resulting in the voltage of $V_{rset}$ at the gate of the drive transistor M0 in the reset phase.

In the compensation phase T2, both the signal at the reset control signal end RS and the signal at the second scan signal end Scan2 are low-level signals, and the first switch transistor M1 and the second switch transistor M2 are turned on, and at the same time the turned-on first switch transistor M1 changes the drive transistor M0 into a diode; and both the signal at the first scan signal end Scan1 and the signal at the light emission control signal end EM are high-level signals, and all of the third switch transistor M3, the fourth switch transistor M4 and the fifth switch transistor M5 are turned off. The data signal $V_{data}$ transmitted from the data signal end Data is written into the first end m1 of the first capacitor C1 so that the voltage at the first end m1 of the first capacitor C1 is $V_{data}$; and after turning on the diode, the voltage $V_{ref1}$ at the first reference signal end Ref1 charges the first capacitor C1 until the voltage at the second end m2 of the first capacitor C1 is $V_{ref1}-|V_{th}|$. At this time the voltage difference across the first capacitor is $V_{data}-V_{ref1}+|V_{th}|$, thereby achieving the storing of the threshold voltage $|V_{th}|$ of the drive transistor M0 at the gate of the drive transistor M0.

In the light emission phase T3, the signal at the light emission control signal end EM is a low-level signal, and the fourth switch transistor M4, the fifth switch transistor M5 and the drive transistor M0 are turned on; and all of the signals at the reset control signal end RS, the first scan signal end Scan1 and the second scan signal end Scan2 are high-level signals, and the first switch transistor M1, the second switch transistor M2 and the third switch transistor M3 are turned off. The voltage $V_{ref2}$ at the second reference signal end Ref2 is written into the first end m1 of the first capacitor C1 so that the voltage at the first end m1 of the first capacitor C1 is changed from $V_{data}$ to $V_{ref2}$, and based upon the principle of charge conservation of the capacitor, in order to ensure that the voltage difference across the first capacitor C1 is still $V_{data}-V_{ref1}+|V_{th}|$, the voltage at the second end m2 of the first capacitor C1 jumps from $V_{ref1}-|V_{th}|$ to $V_{ref1}-|V_{th}|+V_{ref2}-V_{data}$. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K[V_{ref1}-(V_{ref1}-|V_{th}|+V_{ref2}-V_{data})-|V_{th}|]^2=K(V_{data}-V_{ref2})^2$, where K is a structural parameter, which is relatively stable and thus can be regarded as a constant in the same structure. As is apparent from the foregoing, the operating current $I_{OLED}$ of the light emitting element D1 is independent of the threshold voltage $V_{th}$ of the drive transistor M0 and only related to the voltage $V_{data}$ of the signal input at the data signal end and the voltage $V_{ref2}$ at the second reference signal end to thereby thoroughly prevent the operating current $I_{OLED}$ of the light emitting element D1 from being influenced by the drift of the threshold voltage $V_{th}$ of the drive transistor due to the process flow and operating for a long period of time, so as to ensure the normal operation of the light emitting element D1.

Another Example:

Taking the pixel circuit illustrated in FIG. 2B as an example, FIG. 7 illustrates a corresponding timing diagram of the circuit.

In the reset phase T1, the operation principle thereof is the same as the operation principle in the reset phase in the above example. In this phase, the voltage at the first end m1 of the first capacitor C1 is $V_{data}$, and the voltage at the second end m2 of the first capacitor C1 is $V_{rset}$, thereby resulting in the voltage of $V_{rset}$ at the gate of the drive transistor M0 in the reset phase.

In the compensation phase T2, the operation principle thereof is the same as the operation principle in the compensation phase in the above example. However the second capacitor C2 is added to the compensation control module, so in this phase, the voltage $V_{ref1}$ at the first reference signal end Ref1 also charges the second capacitor C2 while charging the first capacitor C1 so that the voltage difference across the first capacitor C1 is $V_{data}-V_{ref1}+|V_{th}|$, and the voltage difference across the second capacitor C2 is $|V_{th}|$, thereby achieving the storing of the threshold voltage $|V_{th}|$ of the drive transistor M0 at the gate of the drive transistor M0.

In the light emission phase T3, the operation principle thereof is the same as the operation principle in the light emission phase in the above example. However the voltage at the gate of the drive transistor M0 is $V_{ref1}-|V_{th}|+(V_{ref2}-V_{data})C_{st1}/(C_{st1}+C_{st2})$ due to the coupling of the first capacitor C1 and the second capacitor C2, and the voltage at the gate of the drive transistor M0 will be relatively stable due to the addition of the second capacitor C2. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K\{V_{ref1}-[V_{ref1}-|V_{th}|+(V_{ref2}-V_{data})C_{st1}/(C_{st1}+C_{st2})]|V_{th}|\}^2=K[(V_{data}-V_{ref2})C_{st1}/(C_{st1}+C_{st2})]^2$, where all of K, $C_{st1}$ and $C_{st2}$ are structural parameters, which are relatively stable and thus can be regarded as constants in the same structure. As can be apparent, the operating current $I_{OLED}$ of the light emitting element D1 is independent of the threshold voltage $V_{th}$ of the drive transistor M0 and only related to the voltage $V_{data}$ of the signal input at the data signal end and the voltage $V_{ref2}$ at the second reference signal end to thereby thoroughly prevent the operating current $I_{OLED}$ of the light emitting element D1 from being influenced by the drift of the threshold voltage $V_{th}$ of the drive transistor due to the process flow and operating for a long period of time, so as to ensure the normal operation of the light emitting element D1.

Figure 8:
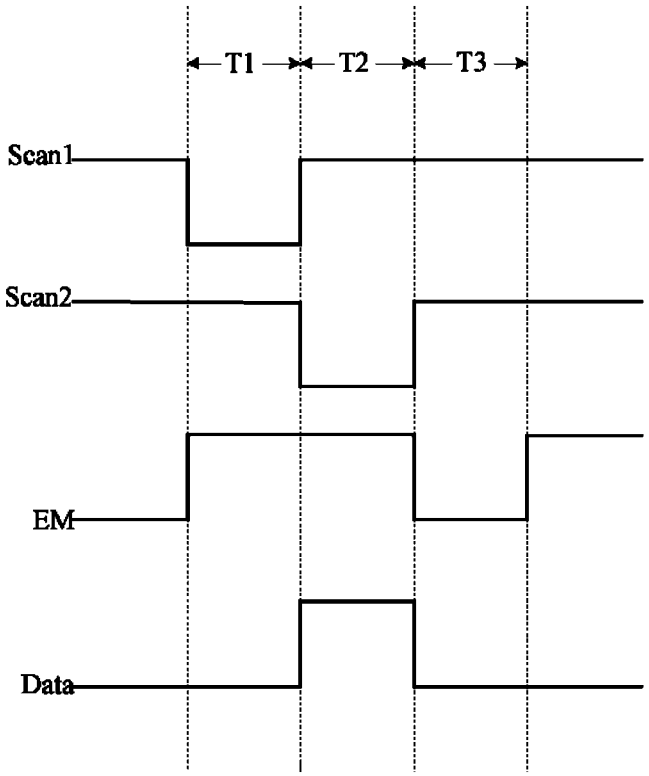
FIG. 8 is a circuit timing diagram of a pixel circuit according to the embodiments.

Another Example:

Taking the pixel circuit illustrated in FIG. 6A as an example, FIG. 8 illustrates a corresponding timing diagram of the circuit.

In the reset phase T1, the signal at the first scan signal end Scan1 is a low-level signal, and the third switch transistor M3 is changed into a diode which is turned on; and both the signal at the second scan signal end Scan2 and the signal at the light emission control signal end EM are high-level signals, and all of the first switch transistor M1, the second switch transistor M2, the fourth switch transistor M4, the fifth switch transistor M5 and the drive switch transistor M0 are turned off. The scan signal $V_{scan2}$ at the second scan signal end Scan2 is written into the second end m2 of the first capacitor C1 through the turned-on diode so that the voltage at the second end m2 of the first capacitor C1 is $V_{scan2}-|V_{th3}|$, thus resulting in the voltage of $V_{scan2}$ at the gate of the drive transistor M0 in the reset phase, where $V_{th3}$ is the threshold voltage of the third switch transistor M3.

In the compensation phase T2, the signal at the second scan signal end Scan2 is a low-level signal, and the first switch transistor M1 and the second switch transistor M2 are turned on, and at the same time the turned-on first switch transistor M1 changes the drive transistor M0 into a diode; and both the signal at the first scan signal end Scan1 and the signal at the light emission control signal end EM are high-level signals, and all of the third switch transistor M3, the fourth switch transistor M4 and the fifth switch transistor M5 are turned off. The data signal $V_{data}$transmitted from the data signal end Data is written into the first end m1 of the first capacitor C1 so that the voltage at the first end m1 of the first capacitor C1 is $V_{data}$; and after turning on the diode, the voltage $V_{ref2}$ at the second reference signal end Ref2 charges the first capacitor C1 until the voltage at the second end m2 of the first capacitor C1 is $V_{ref2}-|V_{th}|$. At this time the voltage difference across the first capacitor C1 is $V_{data}-V_{ref2}+|V_{th}|$, thereby achieving the storing of the threshold voltage $|V_{th}|$ of the drive transistor M0 at the gate of the drive transistor M0.

In the light emission phase T3, the signal at the light emission control signal end EM is a low-level signal, and the fourth switch transistor M4, the fifth switch transistor M5 and the drive transistor M0 are turned on; and both the signal at the first scan signal end Scan1 and the signal at the second scan signal end Scan2 are high-level signals, and all of the first switch transistor M1, the second switch transistor M2 and the third switch transistor M3 are turned off. The voltage $V_{ref2}$ at the second reference signal end Ref2 is written into the first end m1 of the first capacitor C1 so that the voltage at the first end m1 of the first capacitor C1 is changed from $V_{data}$ to $V_{ref2}$, and based upon the principle of charge conservation of the capacitor, in order to ensure that the voltage difference across the first capacitor C1 is still $V_{data}-V_{ref2}+|V_{th}|$, the voltage at the second end m2 of the first capacitor C1 jumps from $V_{ref2}-|V_{th}|$ to $V_{ref2}-|V_{th}|+V_{ref2}-V_{data}$. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K[V_{ref2}-(V_{ref2}-|V_{th}|+V_{ref2}-V_{data})-|V_{th}|]^2=K(V_{data}-V_{ref2})^2$, where K is a structural parameter, which is relatively stable and thus can be regarded as a constant in the same structure. As can be apparent, the operating current $I_{OLED}$ of the light emitting element D1 has been independent of the threshold voltage $V_{th}$ of the drive transistor M0 but only related to the voltage $V_{data}$ of the signal input at the data signal end and the voltage $V_{ref2}$ at the second reference signal end to thereby thoroughly avoid the operating current $I_{OLED}$ of the light emitting element D1 from being influenced by the drift of the threshold voltage $V_{th}$ of the drive transistor due to the process flow and running for a long period of time, so as to ensure the normal operation of the light emitting element D1.

Another Example:

Taking the pixel circuit illustrated in FIG. 6B as an example, FIG. 8 illustrates a corresponding timing diagram of the circuit.

In the reset phase T1, the operation principle thereof is the same as the operation principle in the reset phase in the above example. In this phase, the voltage at the second end m2 of the first capacitor C1 is $V_{scan2}-|V_{th3}|$, thereby resulting in the voltage of $V_{rset}$ at the gate of the drive transistor M0 in the reset phase.

In the compensation phase T2, the operation principle thereof is the same as the operation principle in the compensation phase in the above example. However the second capacitor C2 is added to the compensation control module, so in this phase, the voltage $V_{ref2}$ at the second reference signal end Ref2 also charges the second capacitor C2 while charging the first capacitor C1 so that the voltage difference across the first capacitor C1 is $V_{data}-V_{ref2}+|V_{th}|$, and the voltage difference across the second capacitor C2 is $|V_{th}|$, thereby achieving the storing of the threshold voltage $|V_{th}|$ of the drive transistor M0 at the gate of the drive transistor M0.

In the light emission phase T3, the operation principle thereof is the same as the operation principle in the light emission phase in the above example. However the voltage at the gate of the drive transistor M0 is $V_{ref2}-|V_{th}|+(V_{ref2}-V_{data})C_{st1}/(C_{st1}+C_{st2})$ due to the coupling of the first capacitor C1 and the second capacitor C2, and the voltage at the gate of the drive transistor M0 will be relatively stable due to the addition of the second capacitor C2. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K\{V_{ref2}-[V_{ref2}-|V_{th}|+(V_{ref2}-V_{data})C_{st1}/(C_{st1}+C_{st2})]|V_{th}|]\}^2=K[(V_{data}-V_{ref2})C_{st1}/(C_{st1}+C_{st2})]^2$, where all of K, $C_{st1}$ and $C_{st2}$ are structural parameters, which are relatively stable and thus can be regarded as constants in the same structure. As can be apparent, the operating current $I_{OLED}$ of the light emitting element D1 has been independent of the threshold voltage $V_{th}$ of the drive transistor M0 but only related to the voltage $V_{data}$ of the signal input at the data signal end and the voltage $V_{ref2}$ at the second reference signal end to thereby thoroughly avoid the operating current $I_{OLED}$ of the light emitting element D1 from being influenced by the drift of the threshold voltage $V_{th}$ of the drive transistor due to the process flow and running for a long period of time, so as to ensure the normal operation of the light emitting element D1.

The operation principle has been described here only by taking the four structures of the pixel circuit according to the embodiment of the invention as examples, and the operation principle of the pixel circuit according to the embodiment of the invention in other structures is the same as that in the above examples, and a repeated description thereof will be omitted here.

Figure 9A:
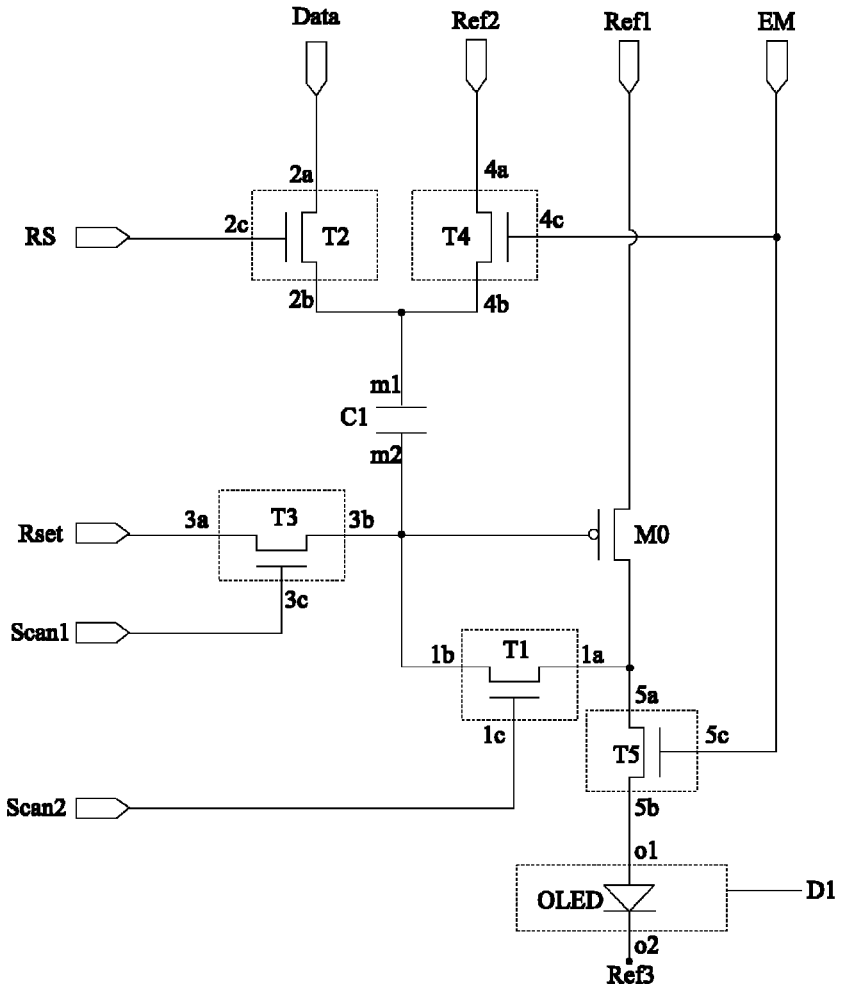
FIG. 9A is a schematic structural diagram of a pixel circuit according to one embodiment of the invention.
Figure 9B:
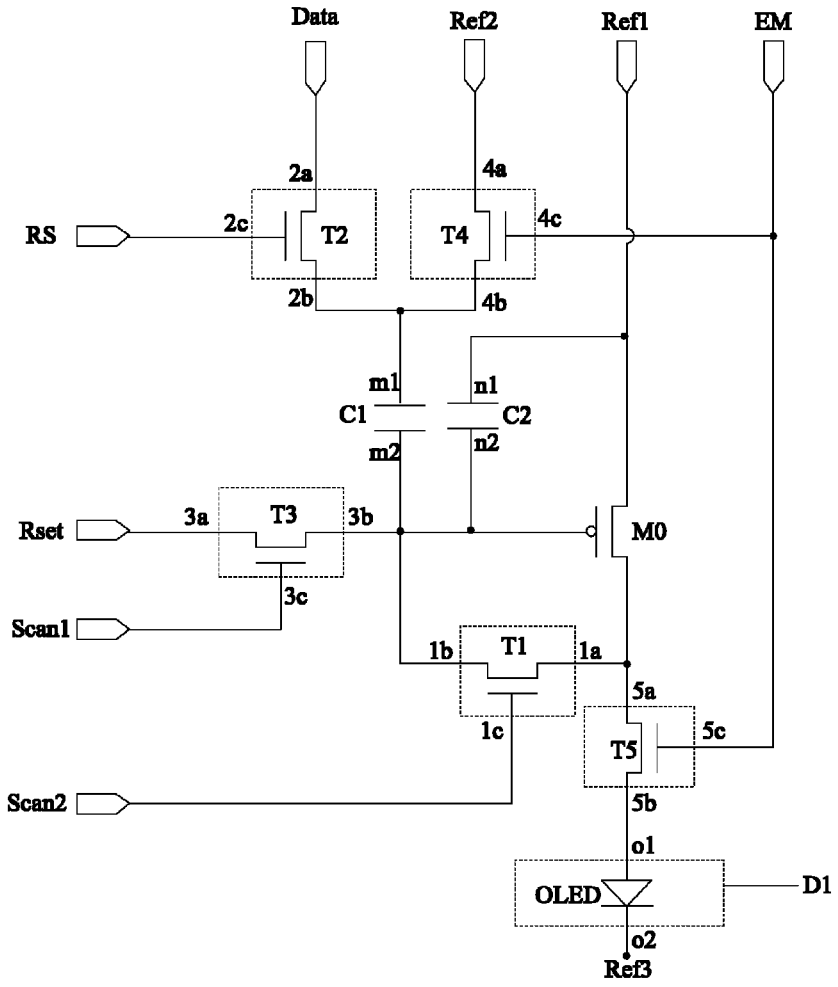
FIG. 9B is a schematic structural diagram of a pixel circuit according to another embodiment of the invention.

Based upon the same inventive concept, an embodiment of the invention further provides a pixel circuit, as illustrated in FIG. 9A and FIG. 9B, which includes a light emitting element D1, a first capacitor C1, a drive transistor M0, a first switch element T1, a second switch element T2, a third switch element T3, a fourth switch element T4 and a fifth switch element T5.

A source of the drive transistor M0 is connected with a first reference signal end Ref1, a drain of the drive transistor M0 is connected respectively with a signal input end 1*a* of the first switch element T1 and a signal input end 5*a* of the fifth switch element T5, and a gate of the drive transistor M0 is connected respectively with a second end m2 of the first capacitor C1, a signal output end 3*b* of the third switch element T3 and a signal output end 1*b* of the first switch element T1; and a control end 1*c* of the first switch element T1 is connected with a second scan signal end Scan2.

A signal input end 2*a* of the second switch element T2 is connected with a data signal end Data, a signal output end 2*b* of the second switch element T2 is connected respectively with a first end m1 of the first capacitor C1 and a signal output end 4*b* of the fourth switch element T4, and a control end 2*c* of the second switch element T2 is connected with a reset control signal end RS.

A signal input end 3*a* of the third switch element T3 is connected with a reset signal end Rset, and a control end 3*c* of the third switch element T3 is connected with a first scan signal end Scan1.

A signal input end 4*a* of the fourth switch element T4 is connected with a second reference signal end Ref2, and a control end 4*c* of the fourth switch element T4 is connected respectively with a control end 5*c* of the fifth switch element T5 and a light emission control signal end EM.

A first end o1 of the light emitting element D1 is connected with a signal output end 5*b* of the fifth switch element T5, and a second end o2 of the light emitting element D1 is connected with a third reference signal end Ref3.

In the above pixel circuit according to the embodiment of the invention, the signal input end of the third switch element is connected with the drain of the drive transistor, and the signal output end of the third switch element is connected with the gate of the drive transistor and the first capacitor, so a drift of the threshold voltage in the drive transistor can be compensated for by the third switch element and the first capacitor, so that an operating current at which the drive transistor drives the light emitting element to emit light can be only related to the voltage of the data signal input at the data signal end and the voltage at the second reference signal end but independent of the threshold voltage of the drive transistor to thereby avoid the influence of the threshold voltage on the light emitting element, so as to stabilize the operating current driving the light emitting element to emit light and improve the uniformity of image brightness in the display area of the display device.

The operation principle of the above pixel circuit according to the embodiment of the invention will be described below briefly.

Particularly the above pixel circuit according to the embodiment of the invention operates in three phases which are a reset phase, a compensation phase and a light emission phase respectively.

In the reset phase, the third switch element writes a reset signal transmitted from the reset signal end into the second end of the first capacitor under control of the first scan signal end. That is, in this phase, the first scan signal end controls the third switch element to be turned on, and the turned-on third switch element writes the reset signal $V_{rset}$ transmitted from the reset signal end into the second end of the first capacitor, so that the voltage at the second end of the first capacitor is $V_{rset}$ to thereby ensure that the voltage at the gate of the drive transistor is $V_{rset}$ in this phase.

In the compensation phase, the second switch element writes a data signal transmitted from the data signal end into the first end of the first capacitor under control of the reset control signal end, and the drive transistor charges the first capacitor through the first switch element under control of the second scan signal end. That is, in this phase, the second scan signal end controls the first switch element to be turned on, and the turned-on first switch element changes the drive transistor into a diode, so that after turning on the diode, the voltage $V_{ref1}$ at the first reference signal end charges the first capacitor until the voltage at the second end of the first capacitor is $V_{ref1}-|V_{th}|$, thereby achieving the storing of the threshold voltage $|V_{th}|$ of the drive transistor at the gate of the drive transistor.

In the light emission phase, all of the fourth switch element, the fifth switch element and the first capacitor control the drive transistor to drive the light emitting element to emit light under control of the light emission control signal end. That is, in this phase, the light emission control signal end controls the fourth switch element and the fifth switch element to be turned on, and the turned-on fourth switch element writes the voltage $V_{ref2}$ at the second reference signal end into the first end of the first capacitor and makes the drive transistor operate in the saturation state, and the turned-on fifth switch element connects the drain of the drive transistor with the light emitting device to thereby drive the light emitting device to emit light.

In the above pixel circuit according to the embodiment of the invention, the operating current at which the drive transistor drives the light emitting element to emit light can be only related to the voltage of the data signal input at the data signal end and the voltage at the second reference signal end but independent of the threshold voltage of the drive transistor to thereby avoid the influence of the threshold voltage on the light emitting element, that is, an image at the same brightness can be obtained when the same data signal and the same second reference signal are loaded to different pixel units, to thereby improve the uniformity of the image brightness in the display area of the display device.

In a particular implementation, the light emitting element D1 in the above pixel circuit according to the embodiment of the invention is generally an Organic Light Emitting Diode (OLED). The light emitting element D1 is operated to emit light for display under the action of the saturated current of the drive transistor M0.

In a particular implementation, in the above pixel circuit according to the embodiment of the invention, the drive transistor M0 driving the light emitting element to emit light is generally a P-type transistor. The threshold voltage $V_{th}$ of the P-type transistor is negative, so in order to ensure the normal operation of the drive transistor M0, the voltage at the first reference signal end Ref1 needs to be a positive voltage, and the voltage at the third reference signal end Ref3 needs to be lower than the voltage at the first reference signal end Ref1. The voltage at the third reference signal end Ref3 being zero will be taken as an example for illustration throughout the following description.

Particularly in a particular implementation, in the above pixel circuit according to the embodiment of the invention, all of the first switch element, the second switch element, the third switch element, the fourth switch element, and the fifth switch element are switch transistors.

It shall be noted that the drive transistor and the switch transistors described in the above embodiments of the invention can be Thin Film Transistors (TFTs) or Metal Oxide Semiconductor (MOS) field effect transistors, and the invention will not be limited in this regard. In a particular implementation, the sources and the drains of these transistors can be interchanged without being distinguished from each other. The particular embodiments are described by taking the drive transistor and the switch transistors, all of which are thin film transistors, as an example.

Particularly in a particular implementation, in the above pixel circuit according to the embodiment of the invention, the sources of the switch transistors are generally the signal input ends of the switch elements, the drains of the switch transistors are generally the signal output ends of the switch elements, and the gates of the switch transistors are generally the control ends of the switch elements.

In a particular implementation, in the above pixel circuit according to the embodiment of the invention, the switch transistor used as the first switch element, the second switch element, the third switch element, the fourth switch element or the fifth switch element can be an N-type transistor or a P-type transistor, and the invention will not be limited in this regard. When the switch transistor is an N-type transistor, the switch transistor is turned on when the signal received at the gate of the switch transistor is at a high level; and when the switch transistor is a P-type transistor, the switch transistor is turned on when the signal received at the gate of the switch transistor is at a low level.

Preferably in order to simplify the process flow of fabricating the pixel circuit, in the above pixel circuit according to the embodiment of the invention, as illustrated in FIG. 9A to FIG. 10B, all of the first switch element T1, the second switch element T2 and the third switch element T3 can be N-type transistors, and of course, all of the first switch element T1, the second switch element T2 and the third switch element T3 can alternatively be P-type transistors.

Figure 10A:
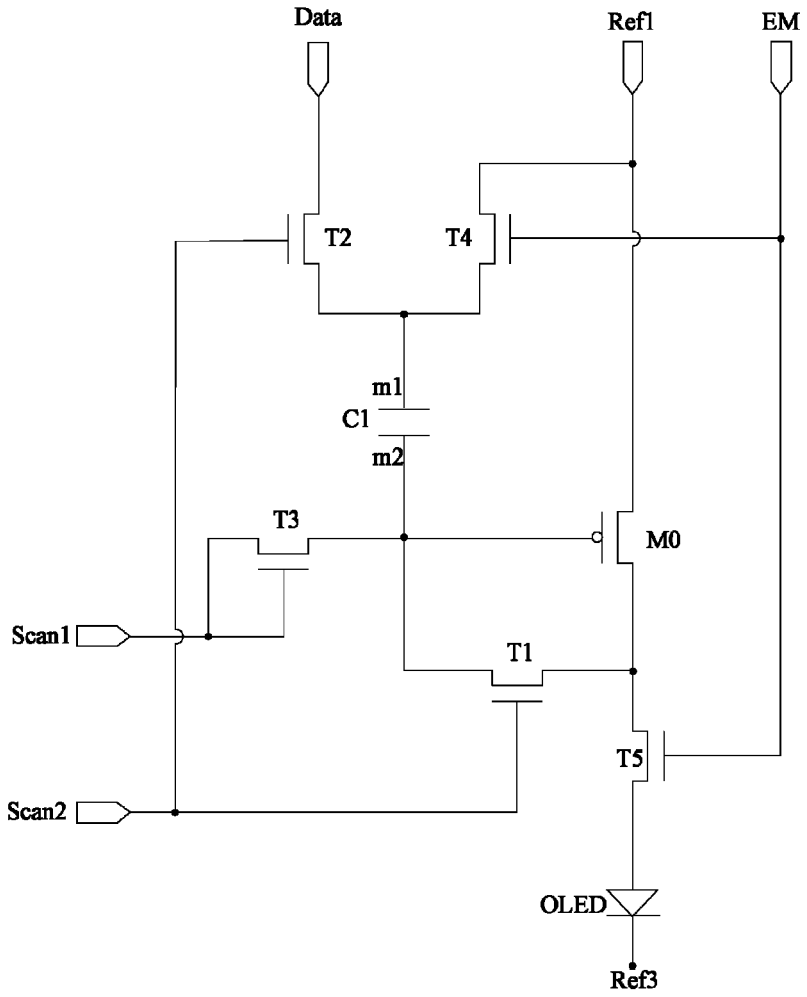
FIG. 10A is a detailed schematic structural diagram of a pixel circuit according to one embodiment of the invention.
Figure 10B:
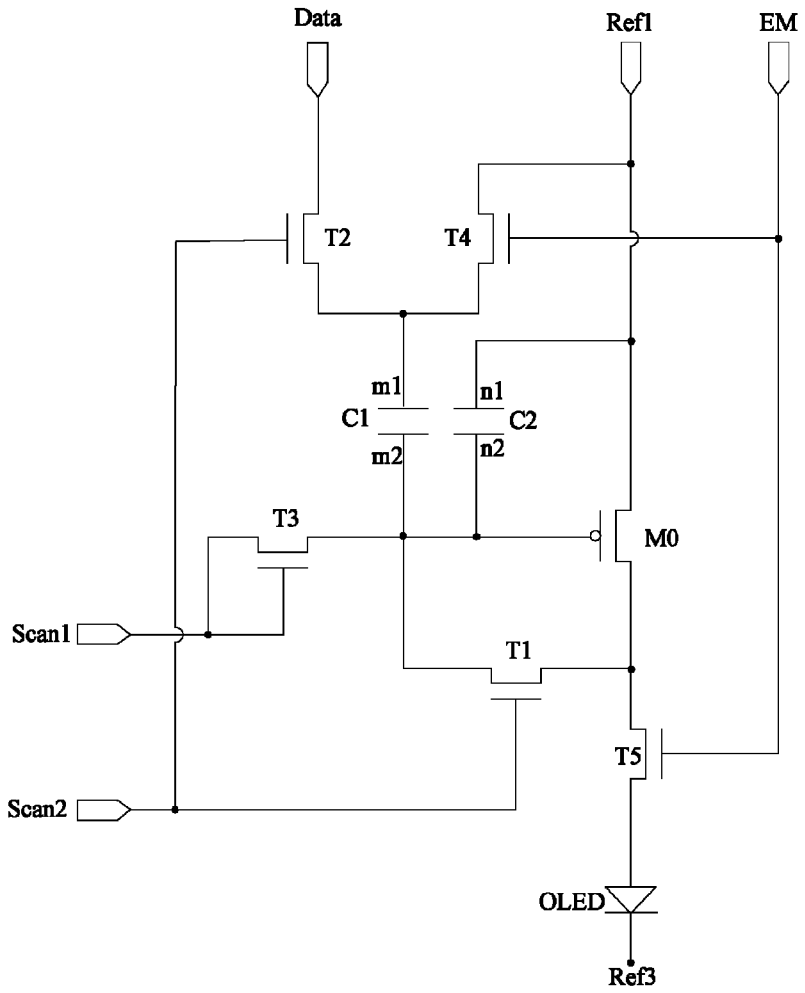
FIG. 10B is a detailed schematic structural diagram of a pixel circuit according to another embodiment of the invention.

Preferably in order to simplify the circuit structure, in the above pixel circuit according to the embodiment of the invention, as illustrated in FIG. 10A and FIG. 10B, when both the second switch element T2 and the third switch element T3 are P-transistors or N-type transistors, the reset control signal end RS can be the second scan signal end Scan2, that is, the second scan signal end Scan2 controls both the first switch element T1 and the second switch element T2 to be turned on and off.

Preferably in order to simplify the circuit structure, in the above pixel circuit according to the embodiment of the invention, as illustrated in FIG. 10A and FIG. 10B, the reset signal end Rset can be the first scan signal end Scan1 or can be the second reference signal end Ref2. When the reset signal end Rset is the first scan signal end Scan1, the first scan signal end Scan1 controls the third switch element T3 to be turned on and off, and also inputs the reset signal to the signal input end of the third switch element T3.

Preferably in order to further simplify the circuit structure, in the above pixel circuit according to the embodiment of the invention, as illustrated in FIG. 10A and FIG. 10B, when both the second switch element T2 and the third switch element T3 are P-type transistors or N-type transistors, the reset control signal end RS is the second scan signal end Scan2, and the reset signal end Rset is the first scan signal end Scan1; or the reset control signal end RS is the second scan signal end Scan2, and the reset signal end Rset is the second reference signal end Ref2.

Preferably in order to simplify the fabrication process, in the above pixel circuit according to the embodiment of the invention, both the fourth switch element and the fifth switch element are P-type transistors or N-type transistors, and the invention will not be limited in this regard. Preferably in order to simplify the circuit structure, in the above pixel circuit according to the embodiment of the invention, as illustrated in FIG. 10A and FIG. 10B, the first reference signal end Ref1 is the second reference signal end Ref2.

Preferably in the above pixel circuit according to the embodiment of the invention, in order to stabilize the voltage at the gate of the drive transistor, as illustrated in FIG. 9B and FIG. 10B, the pixel circuit can further include a second capacitor C2.

A first end n1 of the second capacitor C2 is connected with the first reference signal end Ref1, and a second end n2 of the second capacitor C2 is connected with the gate of the drive transistor M0.

Preferably all of the drive transistor and the switch transistors used as the switch elements mentioned in the above pixel circuit according to the embodiment of the invention can be embodied as P-type transistors to thereby simplify the process flow of fabricating the pixel circuit. Of course, in a particular implementation, in the above pixel circuit according to the embodiment of the invention, the drive transistor is embodied as a P-type transistor, and all of the switch transistors used as the switch elements can be embodied as N-type transistors.

The operation principle of the above pixel circuit will be described below in details by taking the drive transistor which is a P-type transistor, and the switch transistors, all of which are N-type transistors, in the pixel circuit, as an example.

Figure 11:
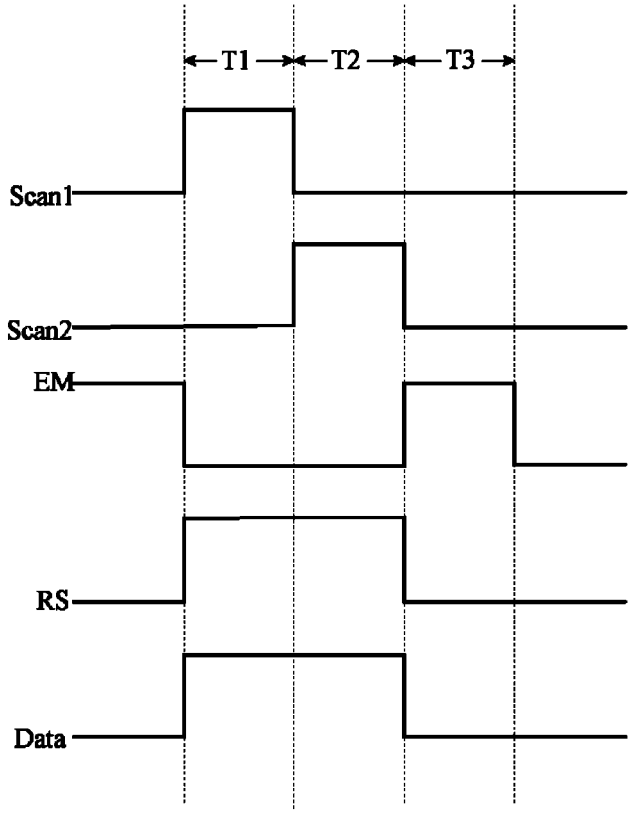
FIG. 11 is a circuit timing diagram of a pixel circuit according to the embodiments.

Another Example:

Taking the pixel circuit illustrated in FIG. 9A as an example, FIG. 11 illustrates a corresponding timing diagram of the circuit.

In the reset phase T1, both the signal at the reset control signal end RS and the signal at the first scan signal end Scan1 are high-level signals, and the second switch element T2 and the third switch element T3 are turned on; and both the signal at the second scan signal end Scan2 and the signal at the light emission control signal end EM are low-level signals, and the first switch element T1, the fourth switch element T4, the fifth switch element T5 and the drive transistor M0 are turned off. The data signal $V_{data}$ at the data signal end Data is written into the first end of the first capacitor C1 through the second switch element T2, and the reset signal $V_{rset}$ at the reset signal end Rset is written into the second end of the first capacitor C1 through the third switch element T3, so that the voltage at the first end of the first capacitor C1 is $V_{data}$, and the voltage at the second end of the first capacitor C1 is $V_{rset}$, thereby resulting in the voltage of $V_{rset}$ at the gate of the drive transistor M0 in the reset phase.

In the compensation phase T2, both the signal at the reset control signal end RS and the signal at the second scan signal end Scan2 are high-level signals, and the first switch element T1 and the second switch element T2 are turned on, and at the same time the turned-on first switch element T1 changes the drive transistor M0 into a diode; and both the signal at the first scan signal end Scan1 and the signal at the light emission control signal end EM are low-level signals, and all of the third switch element T3, the fourth switch element T4 and the fifth switch element T5 are turned off. The data signal $V_{data}$ transmitted from the data signal end Data is written into the first end m1 of the first capacitor C1 so that the voltage at the first end m1 of the first capacitor C1 is $V_{data}$; and after turning on the diode, the voltage $V_{ref1}$ at the first reference signal end Ref1 charges the first capacitor C1 until the voltage at the second end m2 of the first capacitor C1 is $V_{ref1}-|V_{th}|$. At this time the voltage difference across the first capacitor C1 is $V_{data}-V_{ref1}+|V_{th}|$, thereby achieving the storing of the threshold voltage $|V_{th}|$ of the drive transistor M0 at the gate of the drive transistor M0.

In the light emission phase T3, the signal at the light emission control signal end EM is a high-level signal, and the fourth switch element T4, the fifth switch element T5 and the drive transistor M0 are turned on; and all of the signals at the reset control signal end RS, the first scan signal end Scan1 and the second scan signal end Scan2 are low-level signals, and the first switch element T1, the second switch element T2 and the third switch element T3 are turned off. The voltage $V_{ref2}$ at the second reference signal end Ref2 is written into the first end m1 of the first capacitor C1 so that the voltage at the first end m1 of the first capacitor C1 is changed from $V_{data}$ to $V_{ref2}$, and based upon the principle of charge conservation of the capacitor, in order to ensure that the voltage difference across the first capacitor C1 is still $V_{data}-|V_{ref1}+|V_{th}|$, the voltage at the second end m2 of the first capacitor C1 jumps from $V_{ref1}-|V_{th}|$ to $V_{ref1}-|V_{th}|+V_{ref2}-V_{data}$. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K[V_{ref1}-(V_{ref1}|V_{th}|+V_{ref2}-V_{data})-|V_{th}|]^2=K(V_{data}-V_{ref2})^2$, where K is a structural parameter, which is relatively stable and thus can be regarded as a constant in the same structure. As can be apparent, the operating current $I_{OLED}$ of the light emitting element D1 has been independent of the threshold voltage $V_{th}$ of the drive transistor M0 but only related to the voltage $V_{data}$ of the signal input at the data signal end and the voltage $V_{ref2}$ at the second reference signal end to thereby thoroughly avoid the operating current $I_{OLED}$ of the light emitting element D1 from being influenced by the drift of the threshold voltage $V_{th}$ of the drive transistor due to the process flow and running for a long period of time, so as to ensure the normal operation of the light emitting element D1.

Another Example:

Taking the pixel circuit illustrated in FIG. 9B as an example, FIG. 11 illustrates a corresponding timing diagram of the circuit.

In the reset phase T1, the operation principle thereof is the same as the operation principle in the reset phase in the above example. In this phase, the voltage at the first end m1 of the first capacitor C1 is $V_{data}$, and the voltage at the second end m2 of the first capacitor C1 is $V_{rset}$, thereby resulting in the voltage of $V_{rset}$ at the gate of the drive transistor M0 in the reset phase.

In the compensation phase T2, the operation principle thereof is the same as the operation principle in the compensation phase in the above example. However the second capacitor C2 is added to the compensation control module, so in this phase, the voltage $V_{ref1}$ at the first reference signal end Ref1 also charges the second capacitor C2 while charging the first capacitor C1 so that the voltage difference across the first capacitor C1 is $V_{data}-V_{ref1}+|V_{th}|$, and the voltage difference across the second capacitor C2 is $|V_{th}|$, thereby achieving the storing of the threshold voltage $|V_{th}|$ of the drive transistor M0 at the gate of the drive transistor M0.

In the light emission phase T3, the operation principle thereof is the same as the operation principle in the light emission phase in the above example. However the voltage at the gate of the drive transistor M0 is $V_{ref1}-|V_{th}|+(V_{ref2}-V_{data})C_{st1}/(C_{st1}+C_{st2})$ due to the coupling of the first capacitor C1 and the second capacitor C2, and the voltage at the gate of the drive transistor M0 will be relatively stable due to the addition of the second capacitor C2. Since the drive transistor M0 operates in the saturation state, it can be seen from the current characteristic in the saturation state that the operating current $I_{OLED}$ flowing through the drive transistor M0 and used to drive the light emitting element D1 to emit light satisfies the equation of $I_{OLED}=K(V_{sg}-|V_{th}|)^2=K\{V_{ref1}-[V_{ref1}-|V_{th}|+(V_{ref2}-V_{data})C_{st1}/(C_{st1}+C_{st2})]-|V_{th}|\}^2=K[(V_{data}-V_{ref2})C_{st1}/(C_{st1}+C_{st2})]^2$, where all of K, $C_{st1}$ and $C_{st2}$ are structural parameters, which are relatively stable and thus can be regarded as constants in the same structure. As can be apparent, the operating current $I_{OLED}$ of the light emitting element D1 has been independent of the threshold voltage $V_{th}$ of the drive transistor M0 but only related to the voltage $V_{data}$ of the signal input at the data signal end and the voltage $V_{ref2}$ at the second reference signal end to thereby thoroughly avoid the operating current $I_{OLED}$ of the light emitting element D1 from being influenced by the drift of the threshold voltage $V_{th}$ of the drive transistor due to the process flow and running for a long period of time, so as to ensure the normal operation of the light emitting element D1.

The operation principle has been described here only by taking the two structures of the pixel circuit according to the embodiment of the invention as examples, and the operation principle of the pixel circuit according to the embodiment of the invention in other structures is the same as that in the above examples, and a repeated description thereof will be omitted here.

Based upon the same inventive concept, an embodiment of the invention further provides an organic electroluminescent display panel which includes a plurality of the pixel circuits according to any one of the above embodiments of the invention. Since the organic electroluminescent display panel addresses the problem under a similar principle to the pixel circuit described above, for an implementation of the organic electroluminescent display panel, reference can be made to the implementation of the pixel circuit, and a repeated description thereof will be omitted here.

Figure 12A:
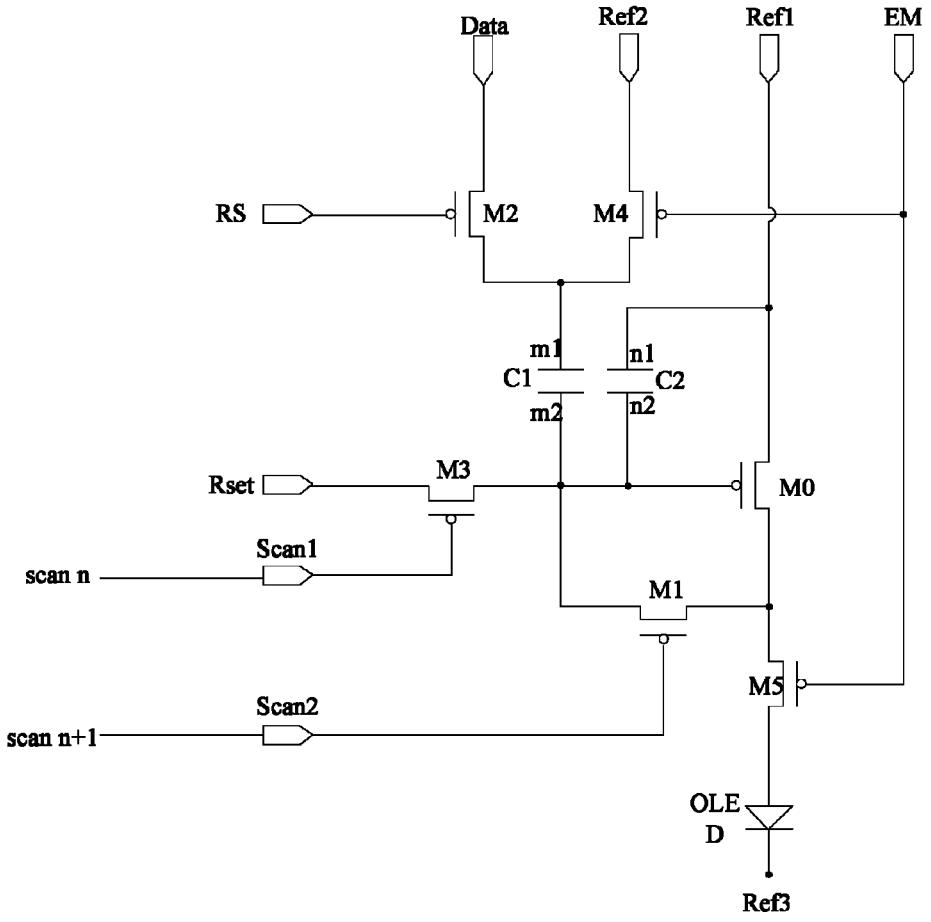
FIG. 12A is a schematic structural diagram of a pixel circuit in an organic electroluminescent display panel according to one embodiment of the invention.
Figure 12B:
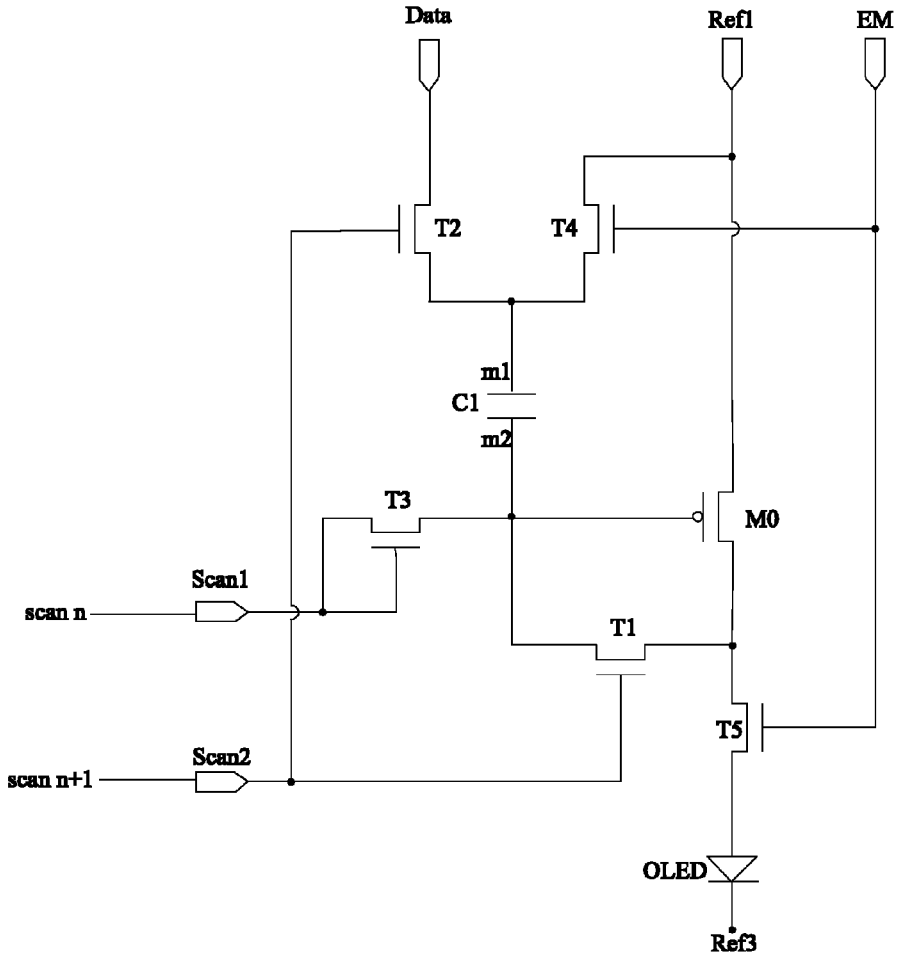
FIG. 12B is a schematic structural diagram of a pixel circuit in an organic electroluminescent display panel according to another embodiment of the invention.

Preferably in order to simplify the circuit structure, in the above organic electroluminescent display panel according to the embodiment of the invention, as illustrated in FIG. 12A and FIG. 12B, each pixel circuit of pixel circuits in the other rows than the last row in the organic electroluminescent display panel has a first scan signal end Scan1 connected with a scan line Scan n of the row where the pixel circuit is located (where n is a positive integer larger than or equal to 1 and smaller than N, and N is the number of scan lines in the organic electroluminescent display panel) and a second scan signal end Scan2 connected with a scan line Scan n+1 of the next row to the row where the pixel circuit is located.

Preferably in order to simplify the circuit structure, in the above organic electroluminescent display panel according to the embodiment of the invention, when the pixel circuit is structurally embodied particularly as the above five switch transistors and one drive transistor according to the above embodiment of the invention, the reset signal end of each pixel circuit in the other rows than the first row in the organic electroluminescent display panel can also be connected with the drain of the fifth switch transistor or the signal output end of the fifth switch element in the previous pixel circuit.

Based upon the same inventive concept, an embodiment of the invention further provides a display device which includes the above organic electroluminescent display panel according to the embodiment of the invention, and the display device can be a display, a handset, a TV set, a notebook computer, an all-in-one machine and the like.It should be understood by those ordinarily skilled in the art that all the other components indispensable to the display device are included, so a repeated description thereof will be omitted here, and the invention will not be limited in this regard.

The embodiments of the invention provide a pixel circuit, an organic electroluminescent display panel and a display device. The pixel circuit includes: a light emitting element, a first capacitor, a reset control module, a drive control module, a compensation control module and a light emission control module. In a reset phase, the reset control module writes a reset signal transmitted from the reset signal end into the second end of the first capacitor under control of the first scan signal end. In a compensation phase, the reset control module writes a data signal transmitted from the data signal end into the first end of the first capacitor under control of the reset control signal end, and the drive control module charges the first capacitor through the compensation control module under control of the second scan signal end; and in a light emission phase, both the light emission control module and the first capacitor control the drive control module to drive the light emitting element to emit light under control of the light emission control signal end. The compensation control module can compensate for the drift of the threshold voltage in the drive control module in the compensation phase, so in the light emission phase, the operating current at which the drive control module drives the light emitting element to emit light can only be related to the voltage of the data signal input at the data signal end and the voltage at the second reference signal end but independent of the threshold voltage in the drive control module to thereby avoid the influence of the threshold voltage on the light emitting element, so as to stabilize the operating current driving the light emitting element to emit light and improve the uniformity of image brightness in the display area of the display device.

Evidently those skilled in the art can make various modifications and variations to the invention without departing from the spirit and scope of the invention. Thus the invention is also intended to encompass these modifications and variations thereto as long as the modifications and variations come into the scope of the appended claims and their equivalents.

What is claimed is:

1. A pixel circuit comprising: a light emitting element, a first capacitor, a reset control module, a drive control module, a compensation control module, and a light emission control module, wherein:

a first signal end of the reset control module is connected with a data signal end, a second signal end of the reset control module is connected with a reset control signal end, and a third signal end of the reset control module is connected respectively with a first end of the first capacitor and a first signal end of the light emission control module; and a fourth signal end of the reset control module is connected with a first scan signal end, a fifth signal end of the reset control module is connected with a reset signal end, and a sixth signal end of the reset control module is connected respectively with a second end of the first capacitor, a first signal end of the compensation control module and a first signal end of the drive control module;

a second signal end of the drive control module is connected with a first reference signal end, and a third signal end of the drive control module is connected respectively with a second signal end of the compensation control module and a second signal end of the light emission control module; and a third signal end of the compensation control module is connected with a second scan signal end, wherein reset control signal end and the second scan signal end are not connected to a common signal end;

a third signal end of the light emission control module is connected with a light emission control signal end, a fourth signal end of the light emission control module is connected with a second reference signal end, and a fifth signal end of the light emission control module is connected with a first end of the light emitting element; and a second end of the light emitting element is connected with a third reference signal end;

in a reset phase, the reset control module provides a data signal transmitted from the data signal end to the first end of the first capacitor under control of the reset control signal end, and the reset control module provides a reset signal transmitted from the reset signal end into the second end of the first capacitor under control of the first scan signal end;

in a compensation phase, the drive control module charges the first capacitor through the compensation control module under control of the second scan signal end; wherein the compensation control module comprises a first switch transistor having a gate connected with the second scan signal end, a source connected with the third signal end of the drive control module, and a drain connected with the second end of the first capacitor; wherein the first switch transistor is turned off in the reset phase, and the first switch transistor is turned on in the compensation phase.

2. The pixel circuit according to claim 1, wherein in a light emission phase, both the light emission control module and the first capacitor control the drive control module to drive the light emitting element to emit light under control of the light emission control signal end.

3. The pixel circuit according to claim 1, wherein the reset signal end is the first scan signal end or the second reference signal end.

4. The pixel circuit according to claim 1, wherein the drive control module comprises a drive transistor having a gate being the first signal end of the drive control module, a source being the second signal end of the drive control module, and a drain being the third signal end of the drive control module.

5. The pixel circuit according to claim 4, wherein the drive transistor is a P-type transistor, a voltage at the first reference signal end is a positive voltage, and a voltage at the third reference signal end is lower than the voltage at the first reference signal end.

6. The pixel circuit according to claim 5, wherein the reset control module comprises a second switch transistor and a third switch transistor, the second switch transistor having a gate connected with the reset control signal end, a source connected with the data signal end, and a drain connected with the first end of the first capacitor, and the third switch transistor having a gate connected with the first scan signal end, a source connected with the reset signal end, and a drain connected with the second end of the first capacitor.

7. The pixel circuit according to claim 6, wherein all of the first switch transistor, the second switch transistor, and the third switch transistor are P-type transistors or N-type transistors.

8. The pixel circuit according to claim 5, wherein the light emission control module comprises a fourth switch transistor and a fifth switch transistor, wherein:

both a gate of the fourth switch transistor and a gate of the fifth switch transistor are connected with the light emission control signal end, a source of the fourth switch transistor is connected with the second reference signal end, and a drain of the fourth switch transistor is connected with the first end of the first capacitor; and a source of the fifth switch transistor is connected with the drain of the drive transistor, and a drain of the fifth switch transistor is connected with the first end of the light emitting element.

9. The pixel circuit according to claim 4 wherein the pixel circuit further comprises a second capacitor, wherein:

a first end of the second capacitor is connected with the first reference signal end, and a second end of the second capacitor is connected with the gate of the drive transistor.

10. A pixel circuit comprising: a light emitting element, a first capacitor, a drive transistor, a first switch element, a second switch element, a third switch element, a fourth switch element, and a fifth switch element, wherein:

a source of the drive transistor is connected with a first reference signal end, a drain of the drive transistor is connected respectively with a signal input end of the first switch element and a signal input end of the fifth switch element, and a gate of the drive transistor is connected respectively with a second end of the first capacitor, a signal output end of the third switch element and a signal output end of the first switch element; and a control end of the first switch element is connected with a second scan signal end;

a signal input end of the second switch element is connected with a data signal end, a signal output end of the second switch element is connected respectively with a first end of the first capacitor and a signal output end of the fourth switch element, and a control end of the second switch element is connected with a reset control signal end, wherein reset control signal end and the second scan signal end are not connected to a common signal end;

a signal input end of the third switch element is connected with a reset signal end, and a control end of the third switch element is connected with a first scan signal end;

a signal input end of the fourth switch element is connected with a second reference signal end, and a control end of the fourth switch element is connected respectively with a control end of the fifth switch element and a light emission control signal end; and a first end of the light emitting element is connected with a signal output end of the fifth switch element, and a second end of the light emitting element is connected with a third reference signal end;

in a reset phase, the second switch element provides a data signal transmitted from the data signal end to the first end of the first capacitor under control of the reset control signal end, and the third switch element provides a reset signal transmitted from the reset signal end into the second end of the first capacitor under control of the first scan signal end;

in a compensation phase, the drive transistor charges the first capacitor through the first switch element under control of the second scan signal end;

wherein the first switch element is turned off in the reset phase, and the first switch element is turned on in the compensation phase.

11. The pixel circuit according to claim 10, wherein in a light emission phase, all of the fourth switch element, the fifth switch element and the first capacitor control the drive transistor to drive the light emitting element to emit light under control of the light emission control signal end.

12. The pixel circuit according to claim 10, the reset signal end is one of the first scan signal end and the second reference signal end.

13. The pixel circuit according to claim 10, wherein the drive transistor is a P-type transistor, a voltage at the first reference signal end is a positive voltage, and a voltage at the third reference signal end is lower than the voltage at the first reference signal end.

14. The pixel circuit according to claim 10, wherein the first reference signal end is the second reference signal end.

15. The pixel circuit according to claim 10, further comprising a second capacitor, wherein:

a first end of the second capacitor is connected with the first reference signal end, and a second end of the second capacitor is connected with the gate of the drive transistor.

16. An organic electroluminescent display panel comprising a plurality of pixel circuits, each of the pixel circuits comprising: a light emitting element, a first capacitor, a drive transistor, a first switch element, a second switch element, a third switch element, a fourth switch element and a fifth switch element, wherein:

a source of the drive transistor is connected with a first reference signal end, a drain of the drive transistor is connected respectively with a signal input end of the first switch element and a signal input end of the fifth switch element, and a gate of the drive transistor is connected respectively with a second end of the first capacitor, a signal output end of the third switch element and a signal output end of the first switch element; and a control end of the first switch element is connected with a second scan signal end;

a signal input end of the second switch element is connected with a data signal end, a signal output end of the second switch element is connected respectively with a first end of the first capacitor and a signal output end of the fourth switch element, and a control end of the second switch element is connected with a reset control signal end, wherein reset control signal end and the second scan signal end are not connected to a common signal end;

a signal input end of the third switch element is connected with a reset signal end, and a control end of the third switch element is connected with a first scan signal end;

a signal input end of the fourth switch element is connected with a second reference signal end, and a control end of the fourth switch element is connected respectively with a control end of the fifth switch element and a light emission control signal end; and a first end of the light emitting element is connected with a signal output end of the fifth switch element, and a second end of the light emitting element is connected with a third reference signal end;

in a reset phase, the second switch element provides a data signal transmitted from the data signal end to the first end of the first capacitor under control of the reset control signal end, and the third switch element provides a reset signal transmitted from the reset signal end into the second end of the first capacitor under control of the first scan signal end;

in a compensation phase, the drive transistor charges the first capacitor through the first switch element under control of the second scan signal end;

wherein the first switch element is turned off in the reset phase, and the first switch element is turned on in the compensation phase.

17. The organic electroluminescent display panel according to claim 16, wherein in a light emission phase, all of the fourth switch element, the fifth switch element and the first capacitor control the drive transistor to drive the light emitting element to emit light under control of the light emission control signal end; and wherein the reset signal end is one of the first scan signal end and the second reference signal end.

18. The organic electroluminescent display panel according to claim 16, wherein each pixel circuit of pixel circuits in other rows than a last row in the organic electroluminescent display panel has a first scan signal end connected with a scan line of a row where the pixel circuit is located and a second scan signal end connected with a scan line of a next row to the row where the pixel circuit is located.

19. A display device, comprising the organic electroluminescent display panel according to claim 16.

* * * * *